US008228348B2

(12) United States Patent
Kimpe

(10) Patent No.: US 8,228,348 B2
(45) Date of Patent: Jul. 24, 2012

(54) METHOD AND DEVICE FOR IMPROVING SPATIAL AND OFF-AXIS DISPLAY STANDARD CONFORMANCE

(75) Inventor: Tom Kimpe, Ghent (BE)

(73) Assignee: Barco N.V., Kortrijk (BE)

( * ) Notice: Subject to any disclaimer, the term of this patent is extended or adjusted under 35 U.S.C. 154(b) by 986 days.

(21) Appl. No.: 11/578,385

(22) PCT Filed: Apr. 15, 2005

(86) PCT No.: PCT/EP2005/004151

§ 371 (c)(1),
(2), (4) Date: Oct. 13, 2006

(87) PCT Pub. No.: WO2005/101355

PCT Pub. Date: Oct. 27, 2005

(65) Prior Publication Data

US 2007/0236517 A1 Oct. 11, 2007

(30) Foreign Application Priority Data

Apr. 15, 2004 (EP) ..... 04447098

(51) Int. Cl.
*G09G 5/10* (2006.01)

(52) U.S. Cl. ..... 345/690; 345/87; 345/88; 345/89; 345/90; 345/691; 345/692; 382/128

(58) Field of Classification Search ..... 345/204, 345/87–90, 690–692; 382/128
See application file for complete search history.

(56) References Cited

U.S. PATENT DOCUMENTS

| | | | | |
|---|---|---|---|---|
| 5,359,342 | A | 10/1994 | Nakai et al. | |
| 6,628,255 | B1 | 9/2003 | Ferrel et al. | |
| 6,954,193 | B1 * | 10/2005 | Andrade et al. | 345/90 |
| 2002/0075277 | A1 | 6/2002 | Naito et al. | |
| 2002/0154076 | A1 | 10/2002 | Greene et al. | |
| 2003/0058211 | A1 * | 3/2003 | Kim et al. | 345/89 |
| 2004/0239682 | A1 | 12/2004 | Breunig et al. | |
| 2005/0068291 | A1 * | 3/2005 | Coley et al. | 345/156 |

FOREIGN PATENT DOCUMENTS

DE 101 45 770 4/2003

(Continued)

OTHER PUBLICATIONS

Search Report of Chinese Patent Office of Nov. 30, 2007 with English Translation related to corresponding Chinese application.

(Continued)

*Primary Examiner* — Nitin Patel
*Assistant Examiner* — Saifeldin Elnafia
(74) *Attorney, Agent, or Firm* — Bacon & Thomas, PLLC

(57) ABSTRACT

The invention describes a method for improving the spatial and off-axis conformance of display systems with respect to an enforced greyscale or color display standard. In the display systems, the native transfer curve is obtained for each pixel or zone of pixels, i.e. as a function of position on the display and as a function of viewing-angle. Once that information is available, an optimal conversion scheme from P-value to DDL can be created for each position on the display and this for all possible viewing-angles. In use, the conversion scheme is used to obtain an improved DICOM behavior. This optimization is also done with respect to the viewing-angle, based on a pre-set, selectable or measured viewing angle.

23 Claims, 14 Drawing Sheets

FOREIGN PATENT DOCUMENTS

| | | | |
|---|---|---|---|
| EP | 1 132 884 | | 9/2001 |
| FR | 2 765 024 | | 12/1998 |
| JP | 1993-80735 | A | 4/1993 |
| JP | 07-028408 | | 1/1995 |
| JP | 10-301092 | | 11/1998 |
| JP | 11-095738 | | 4/1999 |
| JP | 1999-95738 | A | 4/1999 |
| JP | 11-298828 | | 10/1999 |
| JP | 2000-131137 | | 5/2000 |
| JP | 2000-209603 | | 7/2000 |
| JP | 2003-280615 | | 10/2003 |
| JP | 2005-215590 | | 8/2005 |

OTHER PUBLICATIONS

*Digital Imaging and Communication in Medicine* (*DICOM*); Supplement 28: Grayscale Standard Display Function; National Electrical Manufacturers Association; 1998; (56 pages).

Gabriel Marcu et al; Color Correction in TFTLCD Displays for Compensation of color Dependency with Viewing Angle; SID; 2002; p. 713-715.

Assessment of Display Performance for Medical Imaging Systems; American Association of Physicist in Medicine; 2005; (146 pages).

Korean Intellectual Property Office communication for related Korea patent application No. 10-2006-7021179 mailed on May 30, 2011.

Japanese Office Communication for related JP Application No. 507778/2007 mailed on Apr. 12, 2011.

Marcu, G. et al: "Color Correction in TFTLCD Displays for Compensation of Color Dependency with the Viewing Angle", 2002 SID International Symposium Digest of Technical Papers, Boston, MA, May 21-23, 2002, SID International Symposium Digest of Technical Papers, San Jose, CA:SID, US, vol. 33/2, May 2002, pp. 713-715, XP001134313.

* cited by examiner

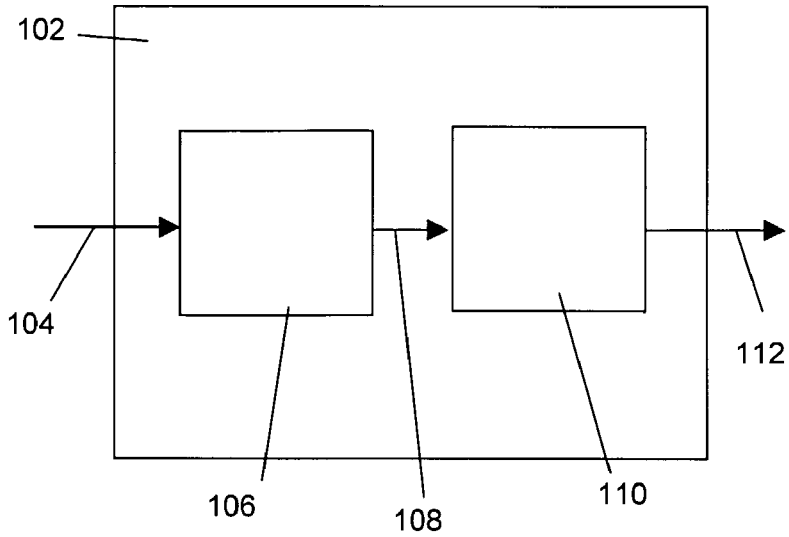
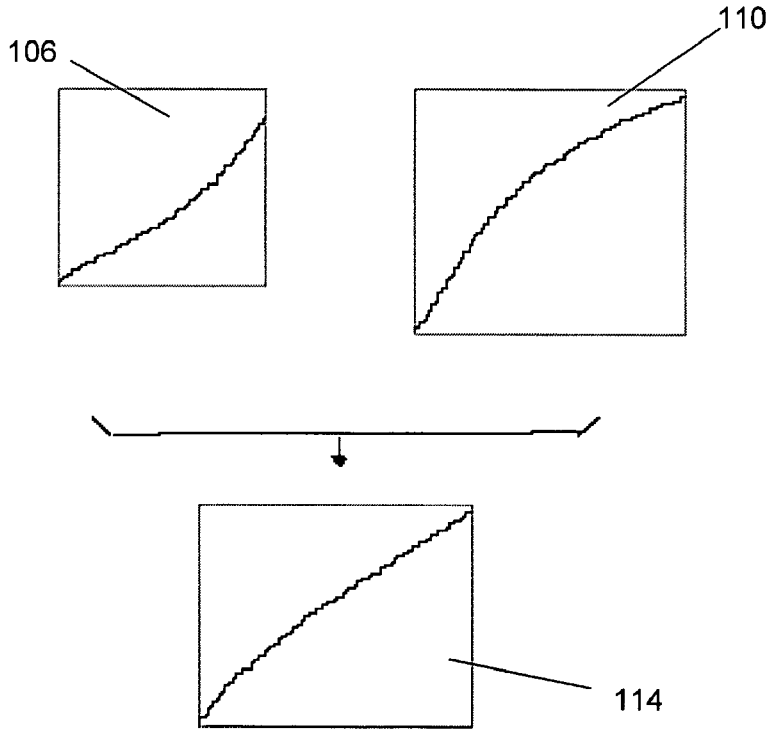
Fig. 1 – PRIOR ART

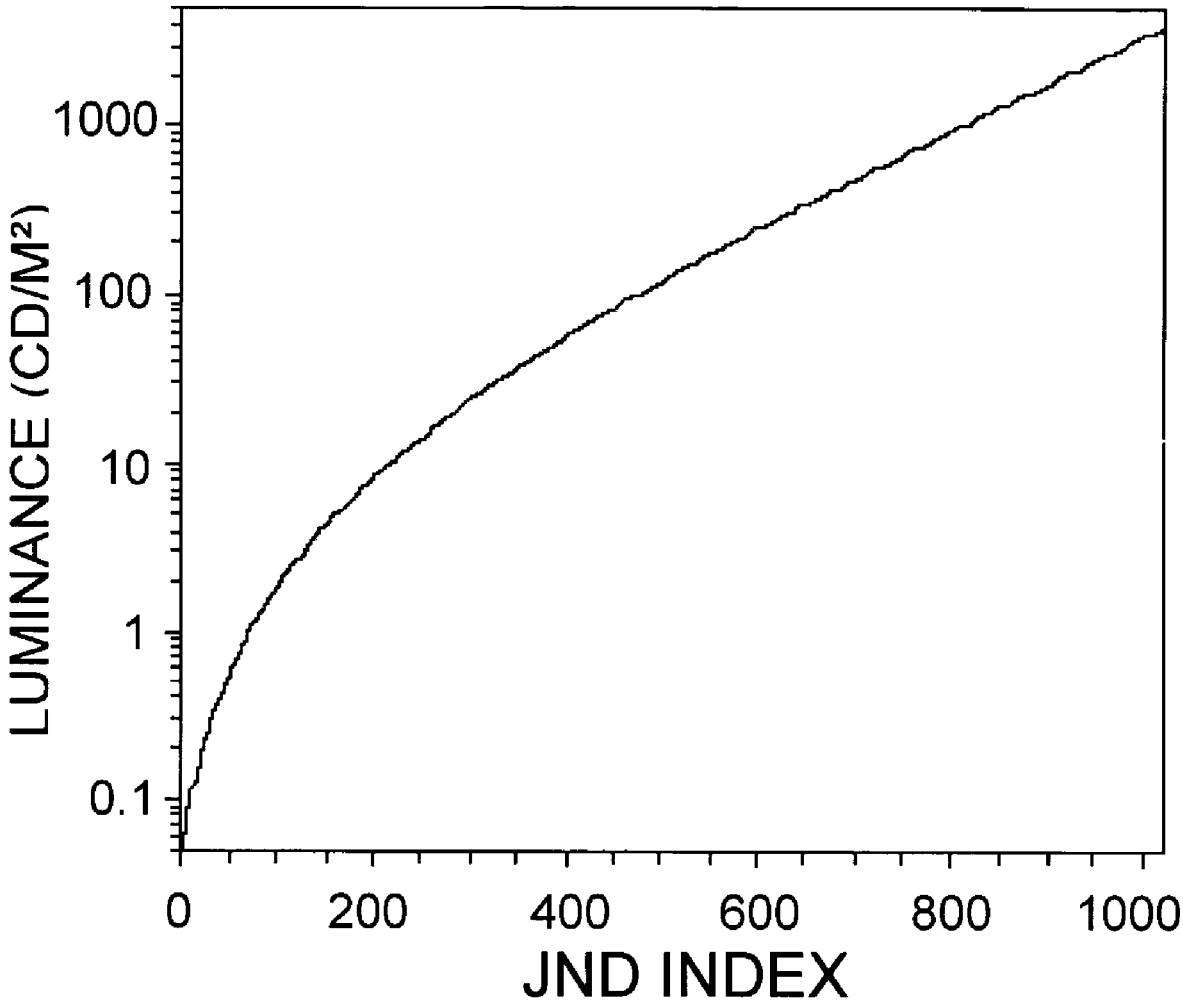
Fig. 2 – PRIOR ART

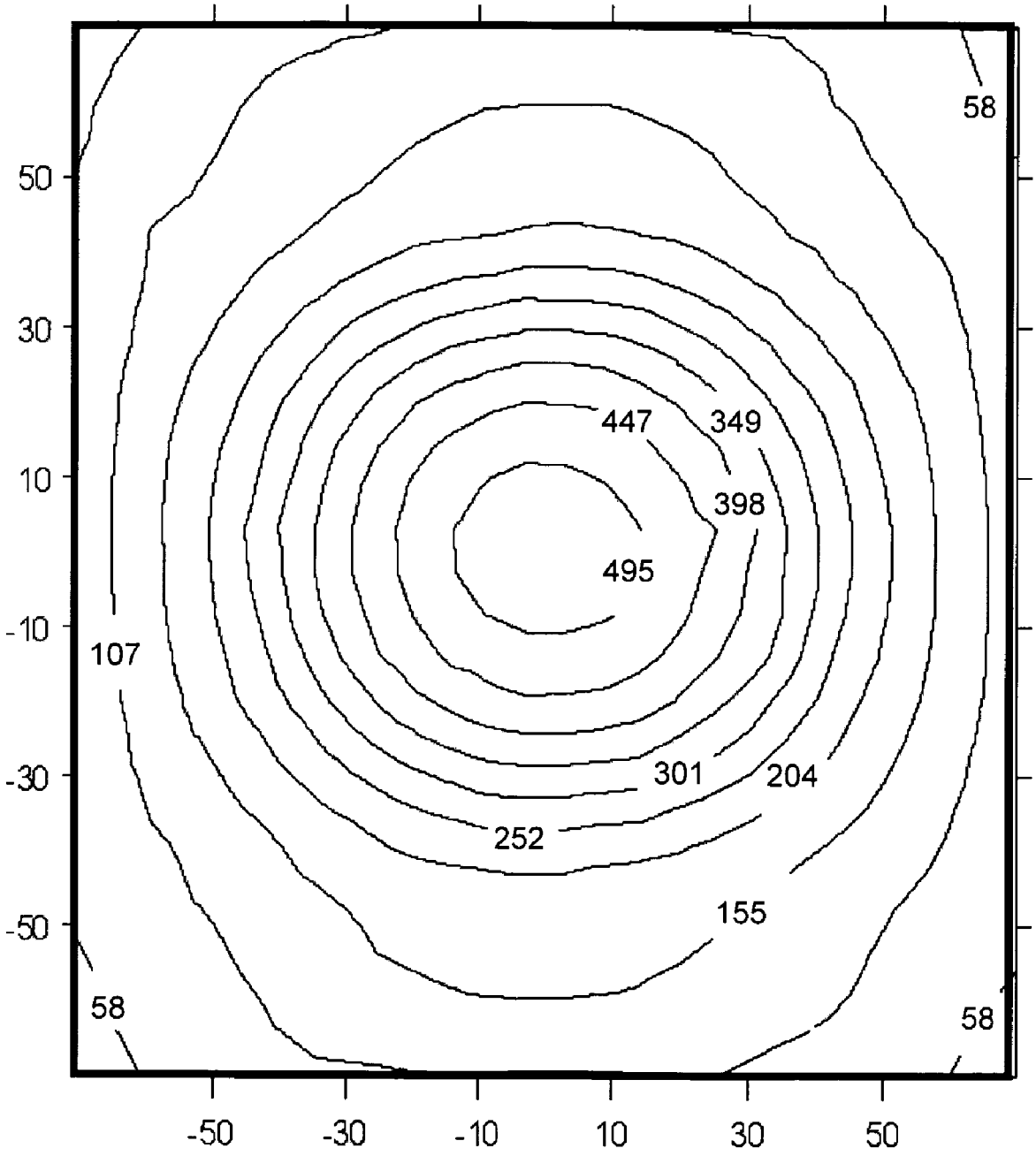
Fig. 3 – PRIOR ART

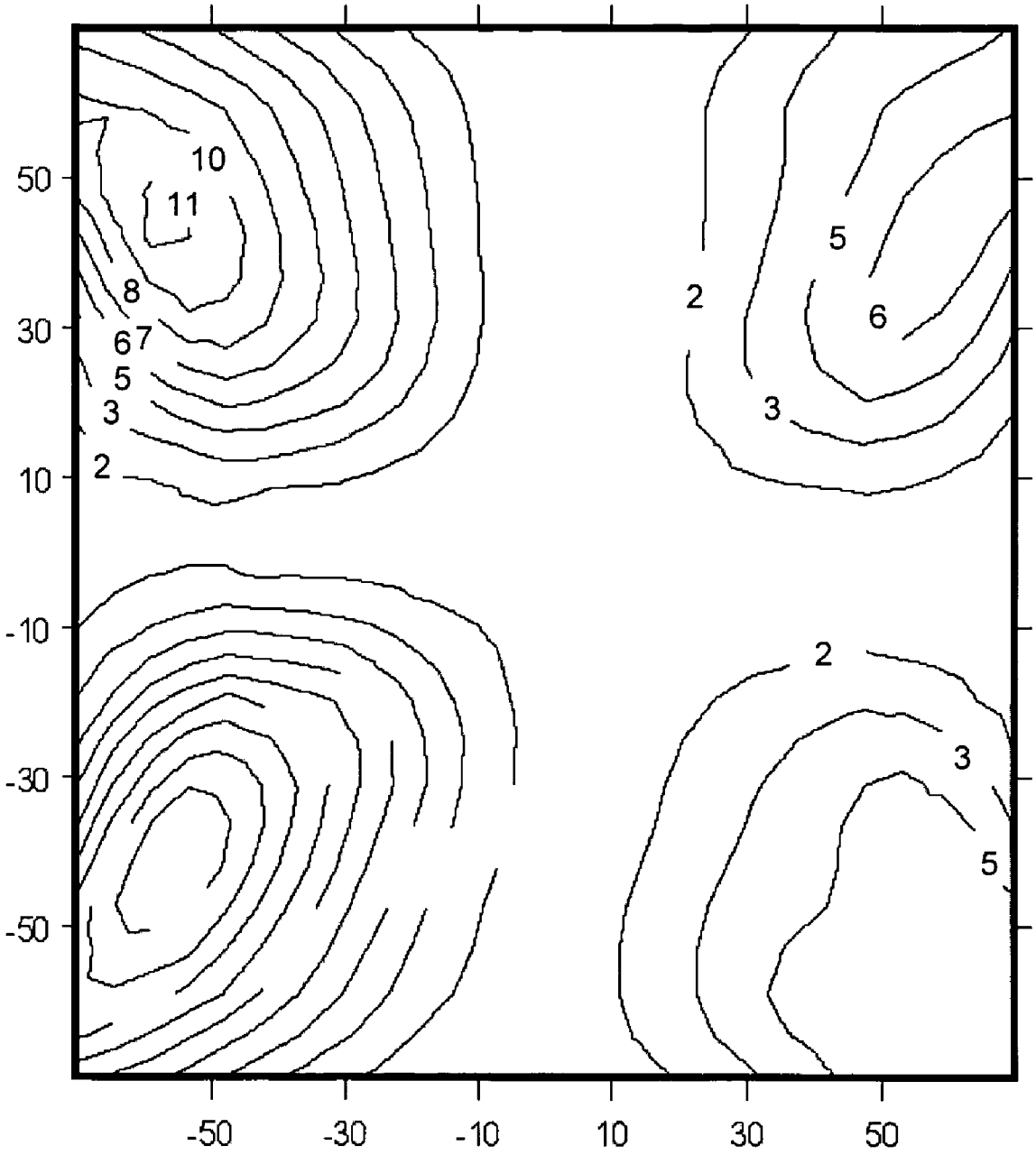
Fig. 4 – PRIOR ART

| | | | | | | | | | | | | | | | | | | |
|---|---|---|---|---|---|---|---|---|---|---|---|---|---|---|---|---|---|---|
| 2 | 2 | 1 | 0 | 0 | 0 | 1 | 2 | 3 | 4 | 4 | 5 | 6 | 6 | 6 | 6 | 5 | 5 | 1 |
| 3 | 3 | 3 | 2 | 2 | 2 | 3 | 4 | 5 | 5 | 5 | 5 | 5 | 6 | 6 | 6 | 6 | 5 | 3 |
| 4 | 5 | 5 | 5 | 5 | 5 | 6 | 6 | 7 | 7 | 7 | 6 | 6 | 6 | 6 | 6 | 5 | 5 | 3 |
| 5 | 6 | 7 | 7 | 7 | 7 | 8 | 9 | 9 | 9 | 8 | 7 | 7 | 6 | 5 | 5 | 5 | 5 | 3 |
| 6 | 6 | 7 | 7 | 8 | 8 | 9 | 9 | 9 | 8 | 7 | 6 | 5 | 5 | 4 | 4 | 4 | 4 | 2 |
| 6 | 7 | 7 | 8 | 9 | 9 | 9 | 10 | 10 | 8 | 7 | 6 | 5 | 5 | 4 | 4 | 3 | 4 | 1 |
| 5 | 5 | 5 | 7 | 8 | 8 | 8 | 8 | 8 | 7 | 6 | 4 | 4 | 3 | 3 | 3 | 2 | 2 | 0 |
| 4 | 5 | 5 | 6 | 6 | 7 | 7 | 7 | 6 | 5 | 4 | 3 | 3 | 2 | 2 | 1 | 1 | 1 | -2 |
| 3 | 4 | 4 | 5 | 5 | 5 | 5 | 6 | 5 | 4 | 3 | 2 | 1 | 1 | 1 | 0 | 0 | 1 | -2 |
| 2 | 3 | 3 | 4 | 4 | 4 | 5 | 5 | 4 | 3 | 3 | 2 | 1 | 0 | 0 | 0 | 0 | 0 | -2 |
| 1 | 2 | 3 | 3 | 4 | 4 | 4 | 4 | 3 | 3 | 2 | 1 | 0 | 0 | 0 | 0 | 0 | 0 | -2 |
| 0 | 1 | 2 | 2 | 3 | 3 | 3 | 3 | 3 | 2 | 1 | 0 | 0 | -1 | -1 | -1 | 0 | -1 | -4 |
| 0 | 0 | 1 | 2 | 2 | 2 | 2 | 2 | 2 | 2 | 1 | 0 | -1 | -1 | -1 | -1 | -1 | -1 | -4 |
| 0 | 0 | 1 | 1 | 1 | 2 | 2 | 2 | 2 | 2 | 1 | 0 | -1 | -1 | -1 | -1 | -1 | -2 | -4 |
| -1 | 0 | 0 | 1 | 1 | 1 | 2 | 2 | 1 | 1 | 0 | 0 | -1 | -1 | -1 | -2 | -2 | -2 | -5 |
| -1 | 0 | 0 | 1 | 1 | 1 | 2 | 2 | 2 | 1 | 0 | 0 | -1 | -1 | -1 | -2 | -3 | -3 | -5 |
| -1 | 0 | 0 | 1 | 1 | 1 | 2 | 2 | 2 | 1 | 0 | 0 | -1 | -1 | -1 | -2 | -2 | -2 | -4 |
| -2 | 0 | 0 | 1 | 1 | 1 | 1 | 1 | 1 | 1 | 0 | 0 | -1 | -1 | -1 | -1 | -2 | -2 | -4 |
| -2 | -1 | 0 | 0 | 0 | 1 | 1 | 1 | 1 | 1 | 0 | 0 | -1 | -1 | -2 | -2 | -2 | -2 | -5 |
| -2 | -1 | -1 | 0 | 0 | 0 | 1 | 1 | 1 | 0 | 0 | -1 | -2 | -2 | -2 | -2 | -2 | -3 | -6 |
| -2 | -2 | -1 | 0 | 0 | 0 | 1 | 1 | 1 | 0 | 0 | 0 | -1 | -1 | -2 | -2 | -2 | -3 | -7 |
| -3 | -2 | -1 | 0 | 0 | 0 | 0 | 1 | 1 | 0 | 0 | 0 | 0 | -1 | -1 | -2 | -2 | -3 | -5 |
| -3 | -2 | -1 | 0 | 0 | 0 | 0 | 0 | 0 | 0 | 0 | 0 | 0 | -1 | -2 | -2 | -2 | -3 | -5 |
| -3 | -2 | -1 | 0 | 0 | 0 | 0 | 0 | 0 | 0 | 0 | 0 | -1 | -1 | -2 | -3 | -3 | -3 | -6 |
| -3 | -2 | -1 | 0 | 0 | 0 | 0 | 0 | 0 | 0 | 0 | 0 | -1 | -1 | -2 | -3 | -3 | -3 | -6 |
| -3 | -2 | -1 | -1 | -1 | -1 | 0 | 0 | 0 | -1 | -1 | -2 | -2 | -3 | -3 | -3 | -4 | -3 | -6 |
| -2 | -2 | -2 | -1 | -1 | -1 | -1 | -1 | -1 | -2 | -4 | -4 | -5 | -5 | -5 | -4 | -4 | -5 | -7 |
| -3 | -3 | -3 | -3 | -2 | -3 | -3 | -3 | -4 | -5 | -7 | -8 | -9 | -8 | -7 | -6 | -6 | -6 | |

Fig. 5 – PRIOR ART

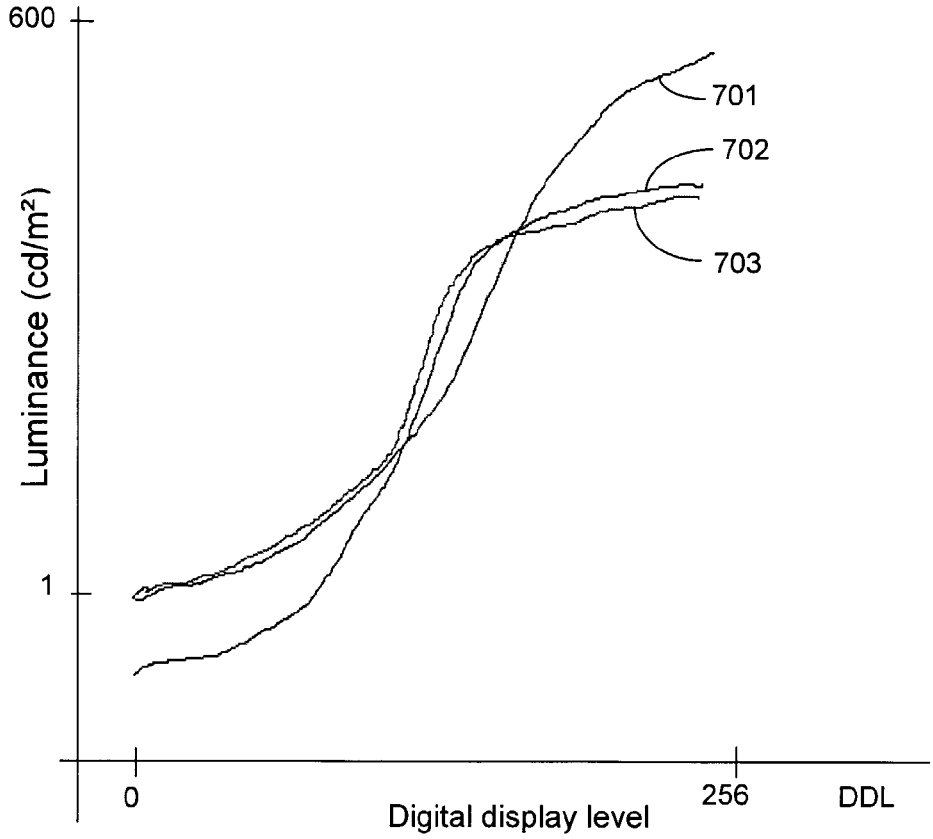
Fig.7a – PRIOR ART
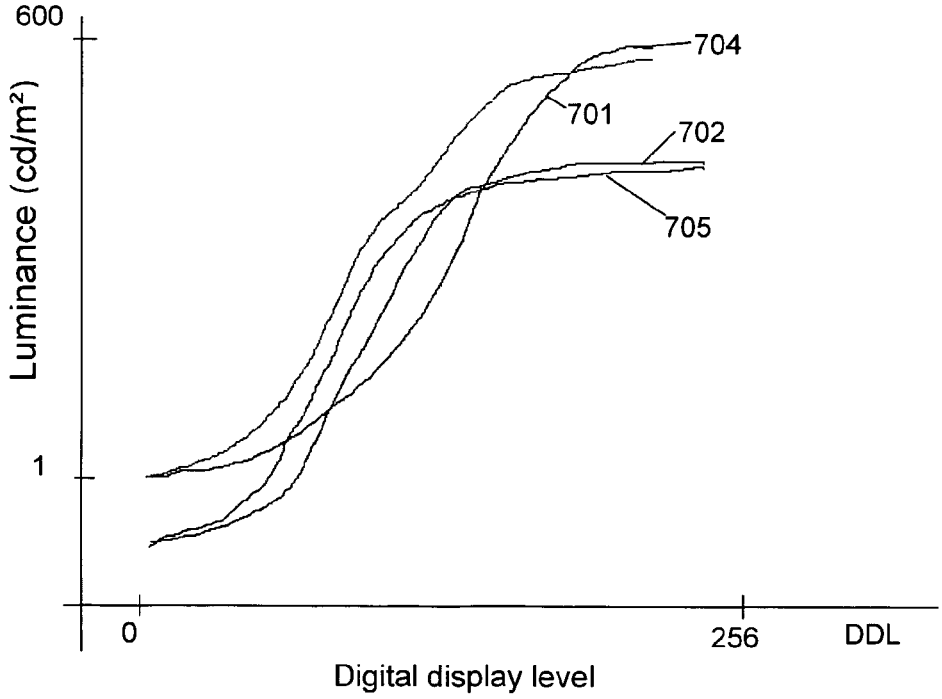
Fig. 7b

METHOD AND DEVICE FOR IMPROVING SPATIAL AND OFF-AXIS DISPLAY STANDARD CONFORMANCE

TECHNICAL FIELD OF THE INVENTION

The present invention relates to systems and methods for electronic display devices, especially fixed format displays. More particularly, the invention relates to systems and methods for electronic display devices complying with enforced display standards, such as for example medical electronic display devices complying with enforced medical display standards like e.g. the DICOM standard.

BACKGROUND OF THE INVENTION

More and more medical displays are used as replacement for traditional film in radiology. Instead of using expensive film a radiologist looks at a digital image on a high-quality (typically greyscale) medical display. An additional advantage of the medical display is that the radiologist is able to perform image-processing operations on the medical image such as contrast enhancement, zoom . . . and this makes it easier to diagnose. It is obvious that medical displays require very high quality and quality control as they are very often used for primary diagnosis and therefore life-critical decision taking. A lot of regulations and recommendations exist. One example of such a quality requirement is the "DICOM/NEMA supplement 28 greyscale standard display function". It describes how the greyscales in a digital medical image should be mapped to the output levels of a medical output device such as a display, a film-printer . . . in order to maximise the visibility of small details present in the digital image file.

General information with respect to medical imaging may be found in the book "Fundamentals of Medical Imaging", by Paul Suetens, Cambridge University Press, 2002. A typical medical image as created by an imaging device (X-ray, ultrasound, scanner . . . ) contains between 256 (8 bit) and 4096 (12 bit) greyscales. However present medical viewing applications normally limit the output to 256 concurrent greyscales. The radiologist then uses window/levelling (a kind of contrast enhancement) to selectively visualise all greyscales in the original image file. Medical displays on the other hand tend to have at least 1024 (10 bit) output greyscales, therefore there are several possibilities to map the 256 greyscales from the medical image to the 1024 available greyscales from the display. Just mapping/selecting these 256 greyscales in a linear way on the 1024 display greyscales will result in loss of information: it will be impossible to visually distinct between some neighbouring greyscale levels from the medical image. This is because present medical displays, which often are LCD-displays, often have a highly irregular transfer curve that strongly differs from the traditional gamma curve of a CRT display and that is not adapted to the more or less logarithmic response of the human eye.

FIG. 1 and FIG. 2 are extracts from the document "DICOM/NEMA supplement 28 greyscale standard display function". FIG. 1 shows the principle of changing the global transfer curve of a display system to obtain a standardised display system 102 according to a standardised greyscale standard display function. In other words, the input-values 104, referred to as P-values 104, are converted by means of a "P-values to DDLs" conversion curve 106 to digital driving values or levels 108, referred to as DDL 108, in such a way that, after a subsequent "DDLs to luminance" conversion, the resulting curve "luminance versus P-values" 114 follows a specific standardised curve. The digital driving levels then are converted by a "DDLs to luminance" conversion curve 110 specific to the display system and thus allow a certain luminance output 112. This standardised luminance output curve is shown in FIG. 2, which is a combination of the "P-values to DDLs" conversion curve 106 and the "DDLs to luminance" curve 110. This curve is based on the human contrast sensitivity as described by the Barten's model. It is to be noted that it is clearly non-linear within the luminance range of medical displays. The greyscale standard display function is defined for the luminance range 0.05 cd/m$^2$ up to 4000 cd/m$^2$. The horizontal axis of FIG. 2 shows the index of the just noticeable differences, referred to as luminance JND, and the vertical axis shows the corresponding luminance values. A luminance JND represents the smallest variation in luminance value that can be perceived at a specific luminance level. A more detailed description can be found in "*DICOM/NEMA supplement* 28 *greyscale standard display function*", published by National Electrical Manufacturers Association in 1998.

A display system that is perfectly calibrated based on the DICOM greyscale standard display function will translate its P-values 104 into luminance values (cd/m$^2$) 112 that are located on the greyscale standard display function (GSDF) and there will be an equal distance in luminance JND-indices between the individual luminance values 112 corresponding with P-values 104. This means that the display system will be perceptually linear: equal differences in P-values 104 will result in the same level of perceptibility at all digital driving-levels 108. In practice the calibration will not be perfect because, typically, only a discrete number of output luminance values (for instance 1024 specific greyscales) are available on the display system.

At present, a "DICOM-calibration" with medical display systems, which often—but not necessary—are LCD displays, is achieved as it has always been done with CRT-displays: by measuring the native transfer curve of the display, i.e. determining the luminance versus DDL, and using this curve to calculate a conversion table between P-values and DDLs. Measuring the native transfer curve of the display is done by placing a luminance measurement device with small acceptance angle in the centre of the display. A device with small acceptance angle is used because otherwise the variation of viewing angle characteristics of the display make the measurement data unreliable. With a device with a large acceptance angle, the measurement results are integrated values over a wide range of viewing angles. Such an approach works well for well-known technologies such as traditional photographic film and CRT-displays, but the specific nature of several of today's medical displays, such as e.g. LCD-displays, and by extension other fixed format displays such as plasma displays, field emission displays, electro luminescent (EL) displays, light emitting diode (LED) and organic light emitting diode (OLED) projection displays, introduces some important unsolved problems that can have a very negative effect on the DICOM-conformance and quality of medical imaging in general.

Several of these medical displays, such as e.g. LCD displays, typically have viewing characteristics which vary with viewing-angle: looking at an angle to the display significantly changes the perceived image. This phenomenon is illustrated in FIG. 3 and FIG. 4, showing the luminance intensity as a function of the horizontal and vertical viewing angle for a full-white video level and a full-black video level respectively. Points corresponding with an equal luminance output are connected for some luminance values. Not only is there a general change in perceived luminance, but also the native transfer curve of the panel changes radically when the panel is looked at an angle. It is obvious that this behaviour can cause poor DICOM-conformance even at small viewing angles, and can introduce a quality risk when diagnosis is performed by looking at a display at an angle. It is to be noted that nowadays it is normal behaviour to look at a medical display at a (small) angle when performing diagnosis, especially when displays are mounted on a wall and/or when multiple radiologists discuss a case together.

Another negative aspect of present high-quality medical displays is that they have variable luminance uniformity over the complete display area.

Especially the darker video levels typically show brighter and darker areas that can differ up to a factor 2 and more in luminance. At higher video levels the situation is somewhat better but still luminance differences of 30%-35% should be considered as normal. FIG. 5 shows an example of the distortion in percent from the mean luminance value over the complete display area for a fixed viewing angle. Also this luminance uniformity problem over the display area causes very bad DICOM-conformance. For people skilled in the art it will be obvious that especially at the darker video levels, even small luminance variations introduce a large distortion from the ideal DICOM-model.

In the past, solutions have been proposed to solve the problem of luminance non-uniformity, as can be seen from e.g. US-2002/154076, EP-1132884 and U.S. Pat. No. 5,359,342. In theory, by making the display completely uniform over its complete area and this for all video levels, the transfer curve will be also the same for all pixels. This means that there is no longer a problem of spatial DICOM-conformance. However, making the transfer curve equal for all pixels is only possible if the dark level of all display pixels is increased to the luminance value of the brightest pixel in the "fully off" state. The same principle holds for the highest video level: the maximal luminance of all pixels must be made equal and thus decreased to the luminance value of the darkest pixel in the "fully on" state. It is obvious that this will result in a display with a high black luminance and a low peak luminance and therefore a poor contrast ratio. A high contrast ratio is exactly one of the requirements of a high-quality medical display. Therefore, the existing solution of making the display completely uniform is not practical.

U.S. Pat. No. 5,359,342 furthermore describes a way to obtain a linear transfer curve for different regions in the display, without normalising the total brightness. Nevertheless, the system does not describe a method for obtaining an optimum DICOM conformance behaviour, whereby the transfer curve is adjusted to the individual variations of display pixels or zones. Furthermore, the correction provided in U.S. Pat. No. 5,359,342 is a constant correction, not taking into consideration the environmental changes or the conditions in which the display is used.

Up to today and to the best of our knowledge, no practical solution for these specific medical display characteristics with reference to DICOM-conformance are known. Until now it was only indirectly possible to improve spatial and off-axis DICOM-conformance of medical displays. The spatial problem could be improved by making the luminance more uniform but with a loss in contrast ratio as a major drawback. For the viewing-angle problems some manufacturers, sometimes not even being aware of it, used sensors with larger acceptance angle during calibration. In this way they achieved a somewhat better DICOM-conformance under small angles but a decrease in DICOM conformance for on-axis viewing.

In "Color correction in TFTLCD displays for compensation of color dependency with the viewing angle", 2002 SID international symposium digest of technical papers, Boston, Mass., May 21-23, 2002, SID international symposium digest of technical papers, San Jose, Calif.: SID US, vol. 33/2, May 2002 (2002-05), pp. 713-715, G. Marcu et al. describe a method for compensation of a pixel colour variation relative to a single viewer position. The method determines the colour correction required for each pixel of a screen, such that a single viewer for a given position can see the colour unaffected by the viewing angle differences to the screen. The colour correction can be recomputed automatically as the viewer position changes, as long as the position is known.

SUMMARY OF THE INVENTION

It is an object of the present invention to provide a compensation method and device for display systems such that an improved spatial and off-axis conformance with an enforced display standard is obtained, and so that from the moment the viewing angle of a user with respect to a display becomes too large the user is warned that looking from that angle is not recommended.

The above objective is accomplished by a method and device according to the present invention.

In a first aspect, the invention relates to a method for correcting non-conformance in greyscale or colour values of a plurality of zones of pixel elements in a matrix display, the correction being with respect to an enforced greyscale or colour display standard, e.g. but not limited to a DICOM standard, each zone of pixel elements being corrected by a different calibration function. The method comprises for each zone of pixel elements independently, storing characterisation data characterising the non-conformance in greyscale or colour values of the zone of pixel elements as a function of its drive signals and pre-correcting, in accordance with the characterisation data, the drive signals of the zone of pixel elements so as to obtain a greyscale or colour level conform the enforced greyscale or colour display standard, the pre-correcting being performed based on an input value of the greyscale or colour value to be displayed and the viewing angle under which the zone of pixel elements is or is to be viewed at. The method furthermore comprises adapting the pre-correcting if the display behaviour is not acceptable. Display behaviour may for example not be acceptable anymore if the viewing angle under which the zone of pixel elements is or is to be viewed at is outside a pre-determined range, e.g. becomes too large, or if an environmental or display dependent parameter changes, such as e.g. ambient light intensity or back-light intensity respectively.

Adapting the pre-correcting may comprise reducing the number of greyscale levels. This number of greyscale levels may be reduced down to a single one, thus changing the display content to a uniform greyscale level so as to warn a user that the display behaviour, from that viewing angle, or due to the changed environmental or display dependent parameter, is not acceptable anymore.

The method may furthermore comprise changing at least one parameter relevant for the quality of a displayed image e.g. changing environmental parameters such as ambient light intensity, changing the backlight intensity, setting another peak luminance value of the display (calibrated white point), changing the colour point of the backlight, changing the colour point of the display. This may be particularly useful when adapting the pre-correcting does not lead to the desired result of enforced grey scale or colour display standard conformance.

In the method of the present invention, the zone of pixel elements may consist of one pixel element or the zone of pixel elements may comprise a plurality of pixel elements, each pixel element of a zone being assigned the same characterisation data. In the method, the viewing angle under which the matrix display is or is to be viewed at may be selectable by a user, e.g. by a switch on the display, or the viewing angle under which the matrix display is or is to be viewed at may be measured using a detection system, e.g. a camera and a corresponding calculation unit.

The characterisation data may furthermore comprise at least one of dependence on backlight intensity and dependence on an environmental parameter. The environmental parameter may be the intensity of the environmental (or ambient) light.

In the method, pre-correcting of the drive signal may be performed based on a look-up table. Pre-correcting the drive signal may also be performed at least partly based on using a mathematical function.

The method may furthermore comprise generating the characterisation data from images captured from individual zones of pixel elements. Generating the characterisation data may comprise building a pixel element profile map representing characterisation data for each pixel element of the matrix display.

The pre-correcting may be carried out in real-time, i.e. during driving of the matrix display while the displaying images concerned. The pre-correcting also may be carried out off-line, i.e. at a time other than during driving of the matrix display while displaying the images concerned.

The enforced greyscale display standard may be the Digital Imaging and Communications in Medicine (DICOM) standard published by National Electrical Manufacturers Association.

The method according to the present invention for correcting non-conformance in greyscale or colour values of a plurality of zones of pixel elements in a matrix display, the correcting being with respect to an enforced greyscale or colour display standard, each zone of pixel elements being corrected by a different calibration function, may furthermore comprise repetitively correcting non-conformance in greyscale or colour values, such that, with a varying correction as a function of time, conformance with the enforced greyscale or colour display standard is obtained and conformance with the enforced greyscale or colour display standard is ensured for changing viewing conditions over time. In particular, the adapted pre-correcting may be changed back to the normal pre-correcting if the viewing angle under which the zone of pixel elements is or is to be viewed at, no longer is outside the pre-determined range. This correction may be performed automatically. The method also may comprise correcting non-conformance in greyscale or colour values by adjusting the degree of output greyscale or colour depth, i.e. adjusting the number of output greyscale or colour values to allow obtaining or more easily obtaining the enforced greyscale or colour display standard.

In a second aspect, the invention also relates to a system for correcting non-conformance in greyscale or colour values of a plurality of zones of pixel elements in a matrix display, the correcting being with respect to an enforced greyscale display standard. The system comprises a memory means for storing characterisation data characterising the non-conformance in greyscale or colour values of the plurality of zones of pixel elements as a function of its drive signals and as a function of a viewing angle under which the zone of pixel elements is or is to be viewed at, and a correction device for pre-correcting, in accordance with the characterisation data, driving signals to the zone of pixel elements to obtain a greyscale or colour level conform an enforced greyscale or colour display standard. The correction device is adapted for adjusting the driving signals if the determined viewing angle is outside a pre-determined range. The correction device may be adapted for adjusting driving signals to the zone of pixel elements so as to obtain a reduced number of greyscale or colour levels. Even down to a single greyscale or colour level.

The system furthermore may comprise a characterising device for generating characterisation data for a number of zones of pixel elements by establishing a relationship between the greyscale or colour levels of each of the zones of pixel elements and the corresponding drive signal for a number of viewing angles and a number of spatial locations in the matrix display. The characterising device may comprise an image-capturing device for generating an image of the pixel elements of the matrix display. In the system, the correction device may comprise a viewing angle determination device for determining the viewing angle of a user with respect to a display system. The characterising device may comprise a light-output value assigning device for assigning a native greyscale or colour luminance level value as a function of its drive signals to a number of zones of pixel elements of the matrix display. The system may be a part of a matrix display for displaying an image.

In a third aspect, the invention also relates to a matrix display device for displaying an image. The matrix display device comprises a plurality of zones of pixel elements, a memory for storing characterisation data for a number of zones of pixel elements of the matrix display, the characterisation data representing a relationship between greyscale or colour levels of a zone of pixel elements and its corresponding drive signals, the characterisation data being a function of the spatial location of the zone of pixel elements in the matrix display and a function of the viewing angle under which the zone of pixel elements is or is to be viewed at, a means for determining the viewing angle of a user with respect to the matrix display and a correction device for pre-correcting, in accordance with the characterisation data, driving signals to the zones of pixel elements so as to obtain a greyscale or colour level conform an enforced greyscale or colour display standard, the correction device being adapted for adjusting the drive signals if the determined viewing angle is outside a pre-determined range. The correction device may be adapted for adjusting the driving signals so that only a reduced number of greyscale or colour levels is represented, even down to a single greyscale or colour level.

In a fourth aspect, the invention also relates to a control unit for use with a system for correction of non-conformance in greyscale or colour values of a plurality of zones of pixel elements of a matrix display for displaying an image, the correction being with respect to an enforced greyscale or colour display standard. The control unit comprises means for storing characterisation data for a number of zones of pixel elements of the matrix display, the characterisation data representing a relationship between greyscale or colour levels of a zone of pixel elements and its corresponding drive signals, the characterisation data being a function of the spatial location of the zone of pixel elements in the matrix display and a function of a viewing angle under which the zone of pixel elements is or is to be viewed at, means for determining the viewing angle of a user with respect to the matrix display, and means for pre-correcting, in accordance with the characterisation data, driving signals to the zone of pixel elements so as to obtain a greyscale colour level conform the enforced greyscale or colour display standard. According to the present invention, the means for pre-correcting is adapted for adjusting the driving signals if the determined viewing angle is outside a pre-determined range, e.g. if the determined viewing angle is too big.

It is an advantage of the present invention that the compensation, for viewing angles within the pre-determined range, does not necessarily decrease significantly the contrast ratio of the medical displays, contrary to existing techniques that improve luminance uniformity. The compensation does not necessarily decrease significantly peak-luminance or increase dark-level output of the display.

It is furthermore an advantage of the present invention that, for viewing angles within the pre-determined range, the improvement of the off-axis DICOM-conformance can be obtained, without necessarily worsening the on-axis DICOM conformance.

It is moreover also an advantage of a specific embodiment of the present invention that the off-axis DICOM conformance can be obtained for a wide variety of viewing situations, i.e. that the DICOM conformance is obtained for different viewing angles.

In a further aspect of the present invention, a method for correcting non-conformance in greyscale or colour values of at least one zone of pixel elements in a matrix display is provided, the correcting being with respect to an enforced greyscale or colour display standard. The method comprises storing characterisation data characterising the non-conformance in greyscale or colour values of the at least one zone of pixel elements as a function of its drive signals, and pre-correcting, in accordance with the characterisation data, the drive signals of said at least one zone of pixel elements so as to obtain a greyscale or colour level conform said enforced greyscale or colour display standard, said pre-correcting being performed based on an input value of the greyscale or colour value to be displayed. The method according to this further aspect furthermore comprises warning a user if a parameter relative to display behaviour has changed such that the display behaviour is not conformant to the enforced greyscale or colour display standard anymore.

The pixel elements in the matrix display may be located in a plurality of zones. Each zone of pixel elements may be corrected by a different calibration function, and the storing and pre-correcting may be done for each zone of pixel elements independently.

Warning a user may comprise one or more of showing a pattern on the screen, overlaying current screen contents, playing a sound, showing a visual signal, sending a message to the user through a communication medium, sending a message to a software application, writing a file on a memory, or logging an event.

The changed parameter relative to display behaviour may be one or more of viewing angle of a user with respect to the matrix display, ambient light intensity, backlight intensity, peak luminance value of the display, colour point of the backlight, temperature.

The present invention also provides a device for correcting non-conformance in greyscale or colour values of at least one zone of pixel elements in a matrix display, the correcting being with respect to an enforced greyscale or colour display standard. The system comprises a memory means for storing characterisation data characterising the non-conformance in greyscale or colour values of the at least one zone of pixel elements as a function of its drive signals, and a correction device for pre-correcting, in accordance with the characterisation data, the drive signals of said at least one zone of pixel elements so as to obtain a greyscale or colour level conform said enforced greyscale or colour display standard. The correction device is adapted for adjusting said pre-correcting based on an input value of the greyscale or colour value to be displayed. The correction device is furthermore adapted for warning a user if a parameter relative to display behaviour has changed such that the display behaviour is not conformant to the enforced greyscale or colour display standard anymore.

The pixel elements in the matrix display may be located in a plurality of zones. Each zone of pixel elements may be corrected by a different calibration function, and the storing and pre-correcting may be done for each zone of pixel elements independently.

For warning a user, the correction device may be adapted so as to do one or more of showing a pattern on the screen, overlaying current screen contents, playing a sound, showing a visual signal, sending a message to the user through a communication medium, sending a message to a software application, writing a file on a memory, or logging an event.

The changed parameter relative to display behaviour may be one or more of viewing angle of a user with respect to the matrix display, ambient light intensity, backlight intensity, peak luminance value of the display, colour point of the backlight, temperature.

In yet a further aspect, the present invention provides a method for correcting non-conformance in greyscale or colour values of at least one zone of pixel elements in a matrix display, the correction being with respect to an enforced greyscale or colour display standard. The method comprises, storing characterisation data characterising the non-conformance in greyscale or colour values of the zone of pixel elements as a function of its drive signals and at least one parameter relevant to display behaviour, pre-correcting, in accordance with the characterisation data, the drive signals of said zone of pixel elements so as to obtain a greyscale or colour lever conform said enforced greyscale or colour display standard, said pre-correcting being performed based on an input value of the grey scale or colour value to be displayed, wherein the pre-correction comprises maximising the overall performance of the display in function of the at least one parameter relevant to display behaviour.

The pixel elements may be located in a plurality of zones of pixel elements. Each zone of pixel elements may be corrected by a different calibration function, and the storing and pre-correcting may be done for zone of pixel elements independently.

The pre-correction may take into account a cost function describing compliance with the enforced display standard in function of the at least one parameter relevant to display behaviour.

The pre-correction may comprise establishing a calibration curve, in whatever suitable format, such as e.g. a LUT, an analytical expression or a sequence of calibration points, obtained by optimising a weighted cost function.

The present invention furthermore provides a device for correcting non-conformance in greyscale or colour values of at least one zone of pixel elements in a matrix display, the correction being with respect to an enforced greyscale or colour display standard. The device comprises a memory means for storing characterisation data characterising the non-conformance in greyscale or colour values of the at least one zone of pixel elements as a function of its drive signals and at least one parameter relevant to display behaviour, and a correction device for pre-correcting, in accordance with the characterisation data, the drive signals of said at least one zone of pixel elements so as to obtain a greyscale or colour lever conform said enforced greyscale or colour display standard, said pre-correcting being performed based on an input value of the grey scale or colour value to be displayed. The correction device is adapted for maximising the overall performance of the display in function of the at least one parameter relevant to display behaviour.

The pixel elements may be located in a plurality of zones of pixel elements. Each zone of pixel elements may be corrected by a different calibration function, and the storing and pre-correcting may be done for each zone of pixel elements independently.

The pre-correction may take into account a cost function describing compliance with the enforced display standard in function of the at least one parameter relevant to display behaviour.

The pre-correction may comprise establishing a calibration curve, in whatever suitable format, such as e.g. a LUT, an analytical expression or a sequence of calibration points, obtained by optimising a weighted cost function.

Although there has been constant improvement, change and evolution of methods and systems in this field, the present concepts are believed to represent substantial new and novel improvements, including departures from prior practices, resulting in the provision of more efficient and reliable devices of this nature.

The teachings of the present invention permit the design of improved methods and apparatus for medical imaging.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 1 is a graphical representation of the conceptual model of a conventional standardised display system that matches P-values to Luminance via an intermediate transformation to digital driving levels of an unstandardised display system.

FIG. 2 is a graphical representation of the prior art Greyscale Standard Display Function (GSDF) presented as logarithm of Luminance versus JND-Index.

FIG. 3 is a graphical representation of the conventional viewing angle dependency of the luminance at full-white video level for a typical LCD display.

FIG. 4 is a graphical representation of the conventional viewing angle dependency of the luminance at full-black video level for a typical LCD display.

FIG. 5 is an illustration of the prior art distortion from the mean luminance value over the complete display area of a display.

FIG. 7*a* is a graph showing the luminance versus digital display level curve according to a method of adjustment commonly known from the prior art.

FIG. 7*b* is a graph showing the luminance versus digital display level curve according to a method of adjustment according to an embodiment of the present invention.

Figure 6:
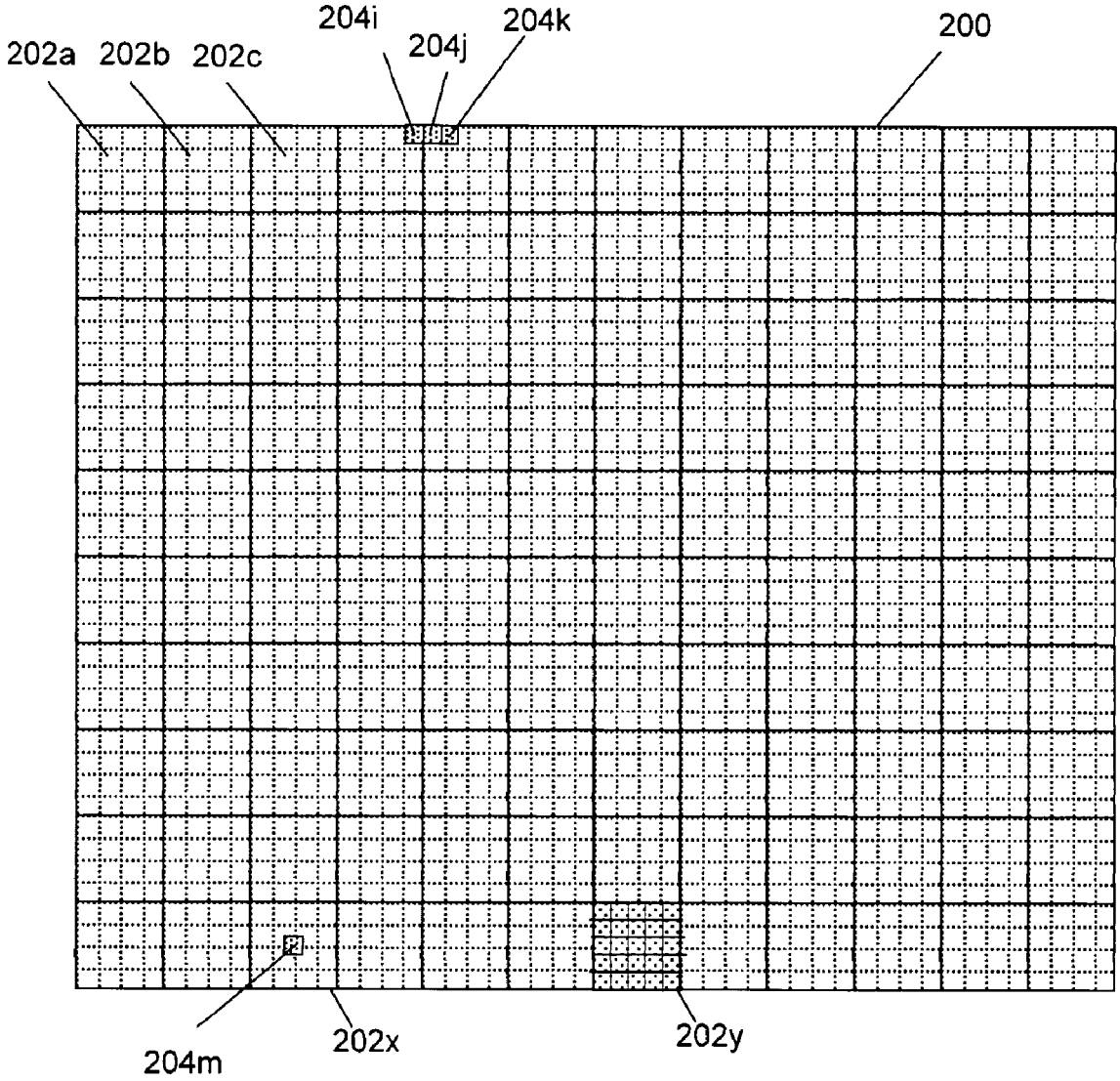
FIG. 6 is a schematic representation of a display suitable for improvement of the spatial and/or off-axis DICOM standard according to an embodiment of the present invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

It is to be noticed that the term "comprising", used in the description and in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Moreover, the terms top, bottom, over, under, left, right, height, width, horizontal and vertical, and the like in the description and the claims are used for descriptive purposes only and not necessarily for describing relative positions. It is to be understood that the terms so used are interchangeable under appropriate circumstances and that the embodiments of the invention described herein are capable of operation in other orientations than described or illustrated herein.

In a first embodiment, the invention provides a system and method for adjusting a display system according to an enforced standard for displaying greyscales. Typically, this problem is encountered in medical imaging, although the invention is not limited thereto. A typical standard used for medical imaging is the Digital Imaging and Communications in Medicine (DICOM) standard published by National Electrical Manufacturers Association. The Greyscale standard is discussed in supplement 28 of the DICOM standard, related to "Greyscale Standard Display Function". Nevertheless, the systems and methods of the present invention also allow compliance with other standards for displaying greyscale levels, in other words the invention is not limited to the greyscale standard of DICOM supplement 28. By way of example, the invention will be described for the greyscale standard of DICOM supplement 28 for a display system.

The display system, which may be a medical electronic display system, comprises a display device which preferably is a fixed format display such as e.g. a plasma display, a field emission display, a liquid crystal display, an electroluminescent (EL) display, a light emitting diode (LED) display or an organic light emitting diode (OLED) display. The invention applies to both monochrome and colour displays and to emissive, transmissive, reflective and trans-reflective display technologies.

A first step in the method of adjusting a display system according to the enforced greyscale standard is characterisation of the emission behaviour of the display system as a function of spatial position and viewing-angle. This means that the native transfer curve of the display system is measured as function of spatial position and as a function of viewing-angle. The transfer curve describes the luminance output (cd/m$^2$) as a function of the digital driving level DDL. For a given display device 200, a number N of measurement positions is chosen. The exact number of measurement positions is not limiting for the present invention and can be selected based on a trade-off between accuracy and required measurement time, and based on the available memory capacity for storing transfer curve related information present in the display device 200. As illustrated in FIG. 6, the measurement points can be related either to parts of the display device 200 comprising a number of pixels, referred to as a zone 202*a*, 202*b*, 202*c*, 202*x*, 202*y*, . . . , or to all individual pixels 2041, 204*j*, 204*k*, 204*m*, . . . of the display device 200, or to individual sub-pixels (not shown in FIG. 6) of the display. For example, the invention being not limited thereto, the display device 200 could be an LCD-panel having a resolution of 2560×2048 pixels and this display device could be divided in 15×12 zones, the zones being the measurement points, or the 2560×2048 pixels could be taken as measurement points. Within the zones, either the transfer curve of the centre pixel can be used, as shown for zone 202*x* with centre pixel 204*m*, the mean native transfer curve of a group of centre pixels can be used or the mean transfer curve of all the pixels in the zone can be used, as illustrated for zone 202*y*. It will be obvious for the person skilled in the art that it is easy to find variations to assign a certain transfer curve to a specific zone of the LCD-panel. Instead of measuring characteristics for all pixels or all zones, another possibility is to measure a limited number of native transfer curves at certain pixels or zones and use interpolation to approximate the curves of pixels or zones in between. This significantly decreases the measurement time. The selection of which type of calibration will be performed will depend, amongst others, upon the quality of the display device 200 used and the time one wishes to spend for performing the calibration.

The exact method to do these characterisation measurements, i.e. to record the native transfer curves, is not limiting for the present invention. By way of example, but not limited thereto, these measurements can be performed by using a single luminance measurement device with a small acceptance angle and measuring sequentially at the different measurement points on the display device. A good acceptance angle typically is around 3°. Some medical standards (such as DIN6868-57) require acceptance angles between 1° and 5°. A typical single luminance measurement device that can be used is e.g. a CA-210 LCD Colour Analyzer constructed by Konica Minolta Photo Imaging USA Inc, a luminance measurement device with a typical acceptance angle of ±2.5°. Another possibility is to use a camera system that can measure multiple locations on the display at the same time. Also camera-systems exist that can perform measurements for several viewing-angles by means of one single image (by using several lenses among which a Fourier-lens). The only requirement is that the measurement device can obtain the transfer curve for the display (sub) pixel or zone (all locations) and for different viewing angles. It is to be noted that these transfer curves can be approximations based on incomplete measurements and interpolation. In a second step, after characterisation of the native transfer curves, the spatial and off-axis DICOM-conformance of the display is improved. This is not done by making the display more uniform over its complete display area, contrary to prior art methods, when the only object is to improve DICOM-conformance, as making the display more uniform implies amongst others a decrease in contrast and brightness. In medical applications, it is often very important to have large contrast images. Contrast is a measure of different brightness in adjacent regions of an image. In other words, it is often not favourable to make the transfer curve of all pixels/zones equal to obtain better DICOM-conformance over the complete display area. An aspect of the present invention is that for every individual display zone or for every individual pixel a DICOM-conformant characteristic is obtained thus following a DICOM-conformant display curve, but that the different pixels/zones can each follow different curves. The allowable error margin for fitting to the DICOM standard is described in e.g. annex C of the Digital Imaging and Communications in Medicine standard, supplement 28: Grayscale Standard Display Function published by National Electrical Manufacturers Association (1998) or in "Assessment of Display Performance for Medical Imaging Systems", Draft Report of the American Association of Physicists in Medicine (AAPM) Task Group 18, Version 9.0, October 2002. It is to be noticed that the display uniformity has not improved and that differences in luminance between pixels/zones will still be present. This is often advantageous, as it allows to obtain images having high brightness in at least some areas of the image. Each pixel/zone will follow a DICOM-curve so that it is guaranteed that small differences in greyscale will be visible at every position on the display (as described by DICOM).

FIG. 7*a* illustrates the approach of improving luminance uniformity to obtain better DICOM conformance, as known from the prior art. FIG. 7*a* shows the transfer curve 701, 702 of 2 pixels at different locations of the display screen 200 and also the resulting transfer curve 703 after luminance correction. The resulting curve after correction is chosen so that it is DICOM-compliant, but results in a major decrease in contrast ratio. FIG. 7*b* illustrates what happens according to a method of the present invention: equalisation of the luminance over the display area is not attempted but rather a correction is performed to the transfer curve 701, 702, of each pixel or zone and this in such a way that the resulting transfer curve 704, 705 for each pixel or zone follows a DICOM-compliant curve. It is to be noted that indeed the two pixels of which the transfer curves 701, 702 are given in FIG. 7*b* do not have the same luminance behaviour after correction, but they do both follow a DICOM-curve. It is also to be noted that there is absolutely no loss of contrast when using the described embodiment of the method of the present invention, as shown in FIG. 7*b*. The end points of original curves 701, 702 respectively and corrected curves 704, 705 respectively fall together. For every pixel or zone, a corrected curve 704, 705 for each transfer curve 701, 702 can be obtained without contrast loss because the DICOM-specification does not specify the required luminance range of the imaging device. For example, a DICOM-conformant curve for a pixel that has a luminance range of 0.5 cd/m$^2$ to 500 cd/m$^2$ can be found but also a DICOM-conformant curve for a pixel that has a luminance range of 1 cd/m$^2$ to 600 cd/m$^2$.

The present invention can also be combined with the prior art techniques, such that increased luminance uniformity, although not perfect, is obtained, while the greyscale-standard conformance is significantly improved and at the same time the contrast loss of the display system is limited.

Thus depending on the characterisation data inputted, a corrected luminance value is displayed as the digital driving level value is adjusted. The characterisation data that needs to be provided comprises an identification of the pixel in order to retrieve the native transfer curve information or immediately the corrected transfer curve information, the original greyscale level, i.e. the digital display level, that was provided for the pixel, and the viewing angle from where the pixel is observed. The identification of the pixel can e.g. be a pixel number, a pixel position on the screen, the pixel column and pixel row, or any suitable alternative representation enabling to identify a pixel. The viewing angle may be provided in different ways, such as being selected at the display system, being selected using a remote control, measured automatically.

To compensate for the viewing angle behaviour of the display system the viewing angle from which the user looks at the display is needed. In this application, the viewing angle is defined as the angle between the on-axis direction, i.e. the direction perpendicular to the plane of the display, and the direction user—display zone. When viewing at a pixel or zone of the display in the on-axis direction, the viewing angle equals zero degrees for that pixel or zone. The viewing angle typically can be translated into a horizontal viewing angle and a vertical viewing angle. The horizontal viewing angle corresponds with the projection of the viewing angle on a plane determined by the perpendicular direction to the plane of the display and the direction of the width of the display, while the vertical viewing angle corresponds with the projection of the viewing angle in a plane determined by the perpendicular direction to the plane of the display and the direction of the height of the display. Typically the horizontal viewing angle during practical use of the display will vary between −70° and +70°, preferably between −60° and +60° and more preferably between −50° and +50°. The vertical viewing angle during practical use of the display will typically vary between −45° and +45°, although positive viewing angles, i.e. viewing angles whereby the display is positioned lower than the viewing means of the user, are more common. Although the invention is not restricted to these ranges of viewing angles, the method and system typically will comprise characterisation data at least for viewing angles within these ranges. In accordance with the present invention the term "user" should be interpreted in the widest possible sense and includes not only animals or humans but also optical viewings systems such as cameras, e.g. as mounted on robots. There are different ways to provide this information. If a screen is only used from a fixed place under a fixed angle, the display may be calibrated during production or installation with respect to this fixed angle of use, such that during operation no additional input is necessary. If the display is used from different locations, i.e. if different viewing angles can be used, the viewing angle needs to be provided to the display to obtain the optimum DICOM conformance. This can be done by providing a selection switch at the display system which allows the viewing angle to be specified. Alternatively, it can be provided a remote control device allowing to select the current viewing angle to be used for DICOM adjustment. In an alternative embodiment, this can be obtained by for instance using a camera or sensor, e.g. a directional infra-red sensor, built into the display housing. For people skilled in the art of image processing it is obvious that it is possible to extract the exact location of the eyes of a human or animal user from an image, even at real-time (for instance 2 times/second). Alternatively, the position of other types of users such as cameras can also be determined by image analysis. Once the location of the optical axis of the user, e.g. the eyes of the user is known then it is easy to calculate the exact horizontal and vertical angle at which the user is viewing the display. It is to be noted that in the above description, as characterisation data, either the same viewing angle can be used for each pixel/zone, which still may introduce a viewing angle dependency as this viewing angle dependency may be inherently different for each pixel/zone, or that even a viewing angle to each pixel or zone of the display may be assigned to make the model more accurate. It is obvious that if a user is close to the display (for instance directly in front) there will be a significant difference in viewing angle for different parts of the display. The centre part of a large display for instance can be looked at on-axis while at the same time the sides will be looked at under (small) angle. If there are multiple users at the same time, the mean value of the viewing angle may be provided to the system. The present invention also includes the use of devices to track the location of the user, e.g. to determine not only the angle of view but also the distance of the viewer from the display. For example, radar or ultrasound can be used for these purposes. The exact way the user location and viewing angle is calculated/measured is not limiting for the present invention. Once the viewing angle and preferably the user distance is known for each pixel or zone this information is used to apply correction to that pixel or zone.

Compensation for viewing angle dependency can be applied as if it were independent of the spatial location of the pixel/zone on the display system, i.e. all pixels/zones using the same viewing angle dependency correction data, or it can be applied as being dependent of the spatial location of the pixel/zone on the display, i.e. each pixel/zone having its own viewing angle behaviour. If the highest quality is desired, it is preferred to compensate in accordance with location on the display as the display panel has different viewing angle behaviours at different locations on the panel area.

Figure 8A:
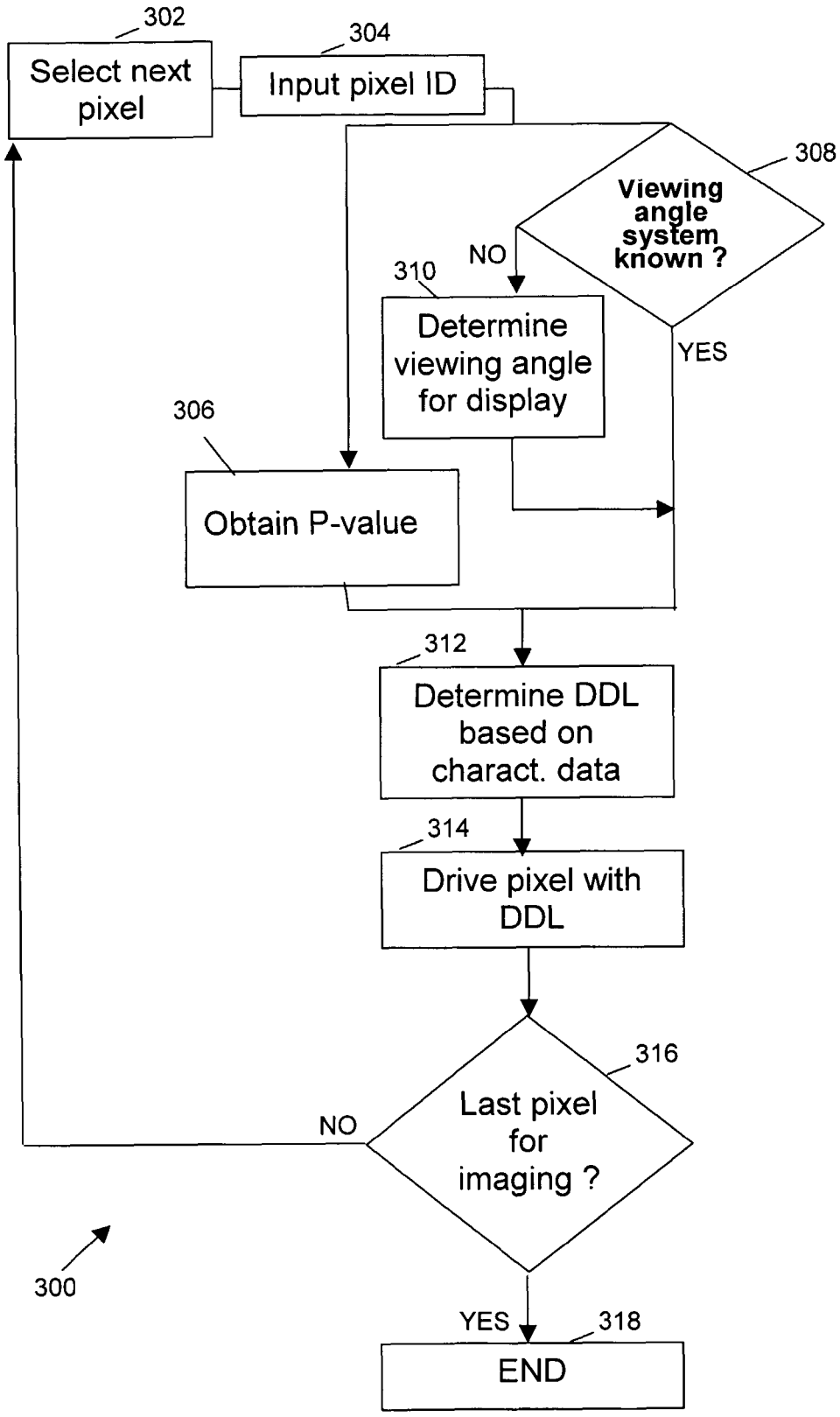
FIG. 8*a* is a schematic flow-chart of a first method for displaying an image with improved DICOM-conformance according to an embodiment of the present invention.
Figure 8B:
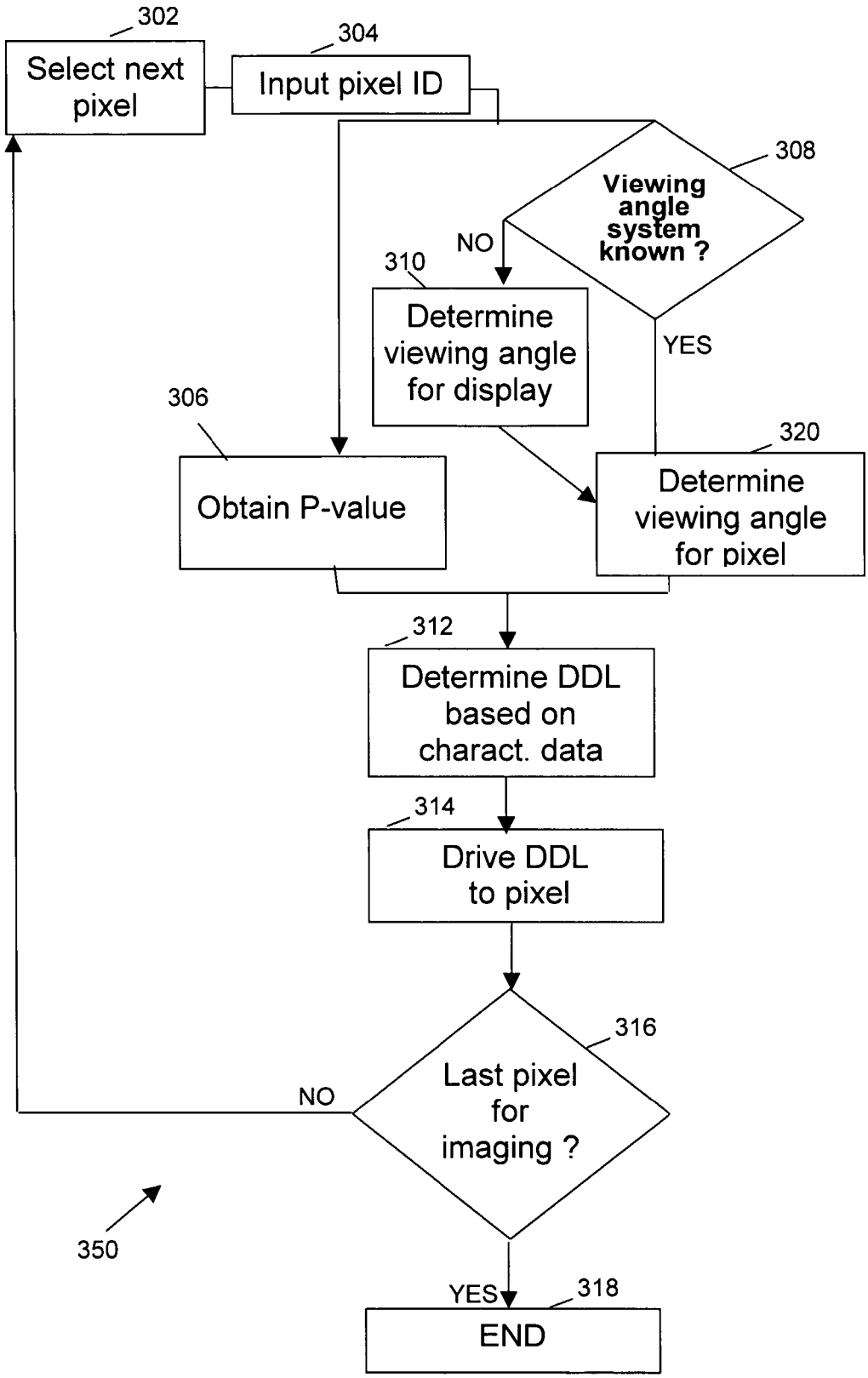
FIG. 8*b* is a schematic flow-chart of a second method for displaying an image with improved DICOM conformance according to another embodiment of the present invention.

By way of example, two correction methods are shown in FIG. 8*a* and FIG. 8*b*.

In FIG. 8*a* it is assumed that the viewing-angle behaviour is not dependent of the exact location on the display system, i.e. all pixels or zones have the same viewing angle dependency. This may be more or less correct for large distances between the user and the display. The correction algorithm then comprises compensation of the spatial variation and compensation of the viewing angle variation using the same viewing angle data for all pixels or zones. FIG. 8*a* shows a flow chart of a method 300 for displaying an image. In a first step 302 a pixel to be imaged is selected. In step 304, pixel identification information is obtained which is needed to retrieve the necessary characterisation data for the pixel to be imaged. In step 306 the input value or P-value for the pixel is obtained, i.e. the value corresponding with the greyscale value that should be imaged by the pixel. In step 308 it is checked whether the viewing angle for the display system is already known. If this is not the case, method 300 proceeds to step 310 wherein the viewing angle for the display system is determined or obtained, e.g. by checking the status of a switch at the display system, by measuring the viewing angle, or by obtaining the viewing angle from a remote control system. In an alternative method, the viewing angle information is prestored in the display system based on measurements on a prototype or mathematical calculations. The obtained characterisation data, i.e. pixel ID, P-value to be displayed and viewing angle information allows to determine the digital driving level value which provides for correction for spatial variation and correction for viewing angle dependency for obtaining a good display standard conformance based on stored correction information which can be obtained for each pixel/zone. This determination is performed in step 312. This digital driving level is then used to drive the pixel thus obtaining an accurate greyscale level (step 314). In step 316 it is checked whether other pixels need to be imaged. If it is not the last pixel for imaging, a next pixel is selected; if, the last pixel of the image to be represented has been converted, the correction method ends (step 318) as the whole image is displayed.

In an alternative method 350, as illustrated in FIG. 8*b*, it is assumed that the viewing angle dependency is not independent of the spatial location on the display system such that the two corrections, for greyscale level and for viewing angle, are coupled and need to be performed at the same time. In other words, this method can be used for a general situation where it is assumed that each position on the display can have a different viewing-angle behaviour. This is shown in FIG. 8*b*. The method comprises the same steps as method 300, but the viewing angle information is specified for each pixel. In other words, an additional step, step 320 is performed wherein the viewing angle information for the display system is used to determine the viewing angle information for the pixel selected in step 302 and identified in step 304. In this way the stored individual viewing angle behaviour of each pixel/zone can be used. A straightforward way of applying this method is keeping a lookup-table to do the compensation. This lookup-table takes as input the P-value (m-bit), an identification of the pixel like e.g. the location of the pixel (row & column, number or zone number) and the viewing angle for the pixel. The output is the DDL that gives best performance for that specific situation.

Some medical displays are used both in portrait and landscape orientation. This means that the display can be physically rotated 90°. In that case it is of course not necessary to store the viewing angle behaviour for both orientations. The viewing behaviour can be measured for the orientation that is mostly used (portrait) and if the display is changed to landscape orientation then the viewing angle data can be rotated 90° and used.

Although two embodiments of methods for correcting are described by way of example, it will be obvious for a person skilled in the art that other correction methods also can be used and that the invention is not limited to the correction methods shown. Various methods can be used to reduce memory requirements. One means for reducing the amount of memory that is necessary for the adjustment methods can be e.g. interpolation. Normally the spatial variation and viewing-angle variation contains not much high-frequency components so only a limited number of measurement points can be stored and an interpolation scheme to approximate the missing data in between can be used. This system can significantly reduce the storage requirements although extra functionality is needed for the interpolation circuit. Yet another possibility is to describe the spatial and/or viewing-angle variation or the corresponding correction data by means of mathematical functions. Examples of such functions, but not limited thereto, can be polynomials; a set of coefficients of cosines functions, . . . . Another possibility is to reference all characterisation and/or correction data relative to a chosen typical data-set. For instance reference can be made relative to the correction/characterisation of the centre of the display. Typically this technique will require less storage area, as in this case the values of the correction coefficients will be smaller thus resulting in less bits needed to store them. A variant to the reference data/characterisation is to delta-encode the characterisation/correction data, i.e. the difference with the previous data, in this case the neighbouring location or viewing angle is used. Also symmetry in the data can be exploited to reduce the storage requirements. The viewing angle behaviour will have rather good point symmetry around the on-axis point. A somewhat more complex solution is to group or classify the characterisation or correction data into a number of reference classes with the intention to significantly reduce the required storage area. It can for instance be envisaged to group pixels or zones that require the same (or approximately the same, within a pre-set limit) spatial compensation. Instead of storing that compensation data then for each pixel or zone, a small reference class can be stored for each pixel or zone and the actual larger compensation data can be stored only once. The same holds for the viewing angle behaviour. Of course this clustering can be done for spatial compensation and/or viewing angle compensation independently or together. For people skilled in the art it will be clear that lots of algorithms exist to group elements in classes, such as vector quantization, neural networks . . . . Thus lookup tables and circuitry based on interpolation circuits or mathematical functions or a combination thereof can be used. It is furthermore to be noted that it is also possible to combine existing lookup-tables used for image enhancement, with the lookup-tables or compensation needed for the present invention.

Figure 9:
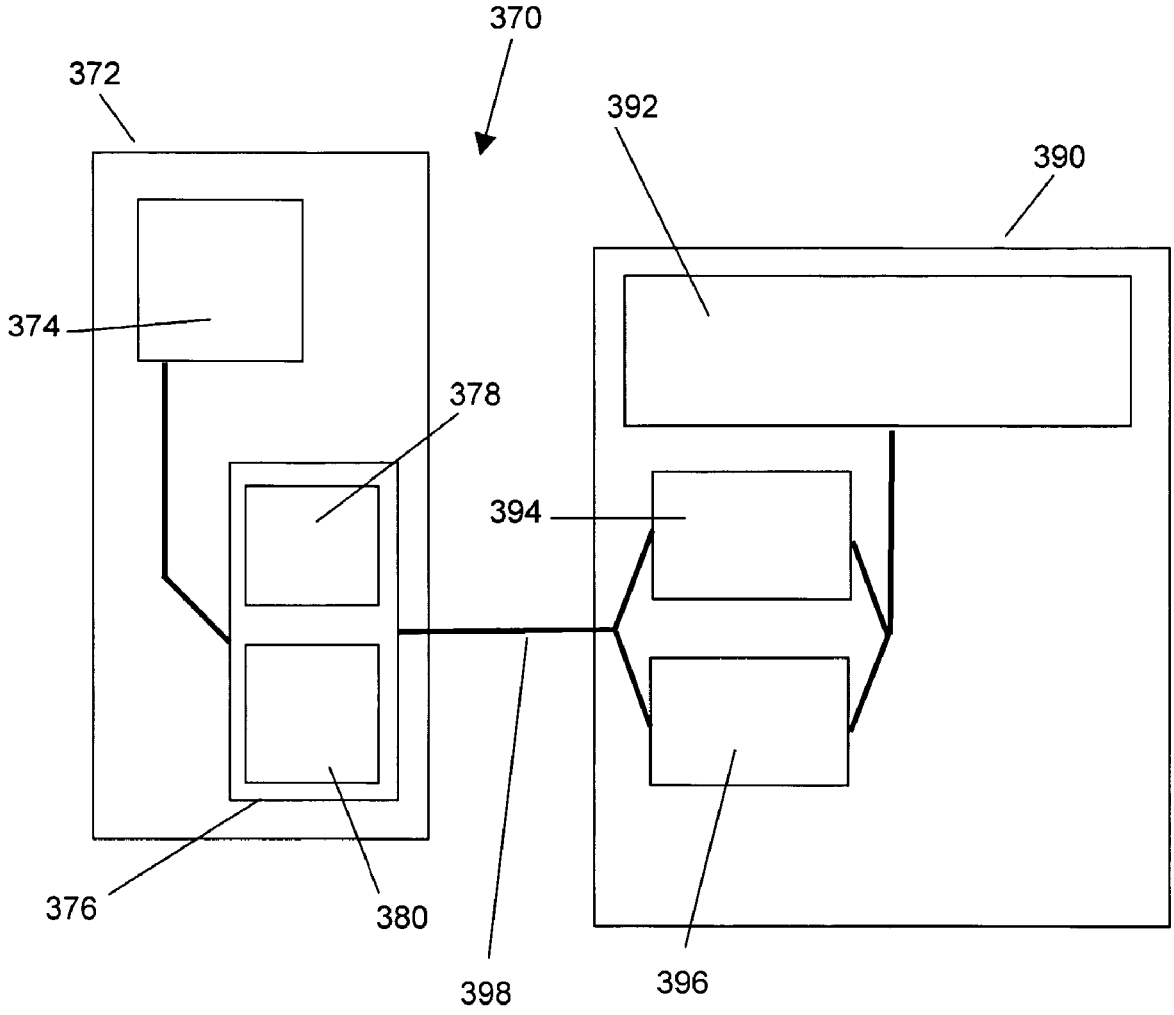
FIG. 9 is a schematic representation of the different components of a suitable system for performing adjustment to obtain improved DICOM conformance, according to an embodiment of the present invention.

The correction methods and algorithms described in the present invention can be executed both real-time, i.e. during driving of the matrix display while displaying images, or offline, i.e. not during driving of the matrix display so as to display the images. In FIG. 9 a number of different locations to perform a real-time correction in a system 370 is shown. The system 370 comprises a host computer 372 and a display system 390. The host computer 372 can be any conventional computer providing a significant high quality central processing unit CPU 374 and a significant high quality graphical card 376. The graphical card 376 comprises a software component, which typically can be firmware 378 and a hardware component 380.

The pixel correction can be done by the CPU 374 of the host computer 372, such as for example by means of the driver code of the graphical card 376 or with a specific application or embedded in a viewing application. Alternatively, pixel correction also can be performed in the graphical card 376 itself, either in a hardware component 380 of the graphical card 376, or in a firmware component 378 of the graphical card 380. In another alternative, the pixel correction also can be performed in the display system 390 itself, either in display hardware 394 or in display firmware 396. A further alternative is to perform the pixel correction on the signal transmitted between the graphical card 376 and the display system 390, i.e. is somewhere during this transmission in the transmission channel 398. It is also possible to split the pixel processing such that part of it is performed in a first component of the system 370, e.g. the CPU 374 of the host computer 372, and part is performed in a second component of the system 370, e.g. in the display hardware 394.

Figure 10A:
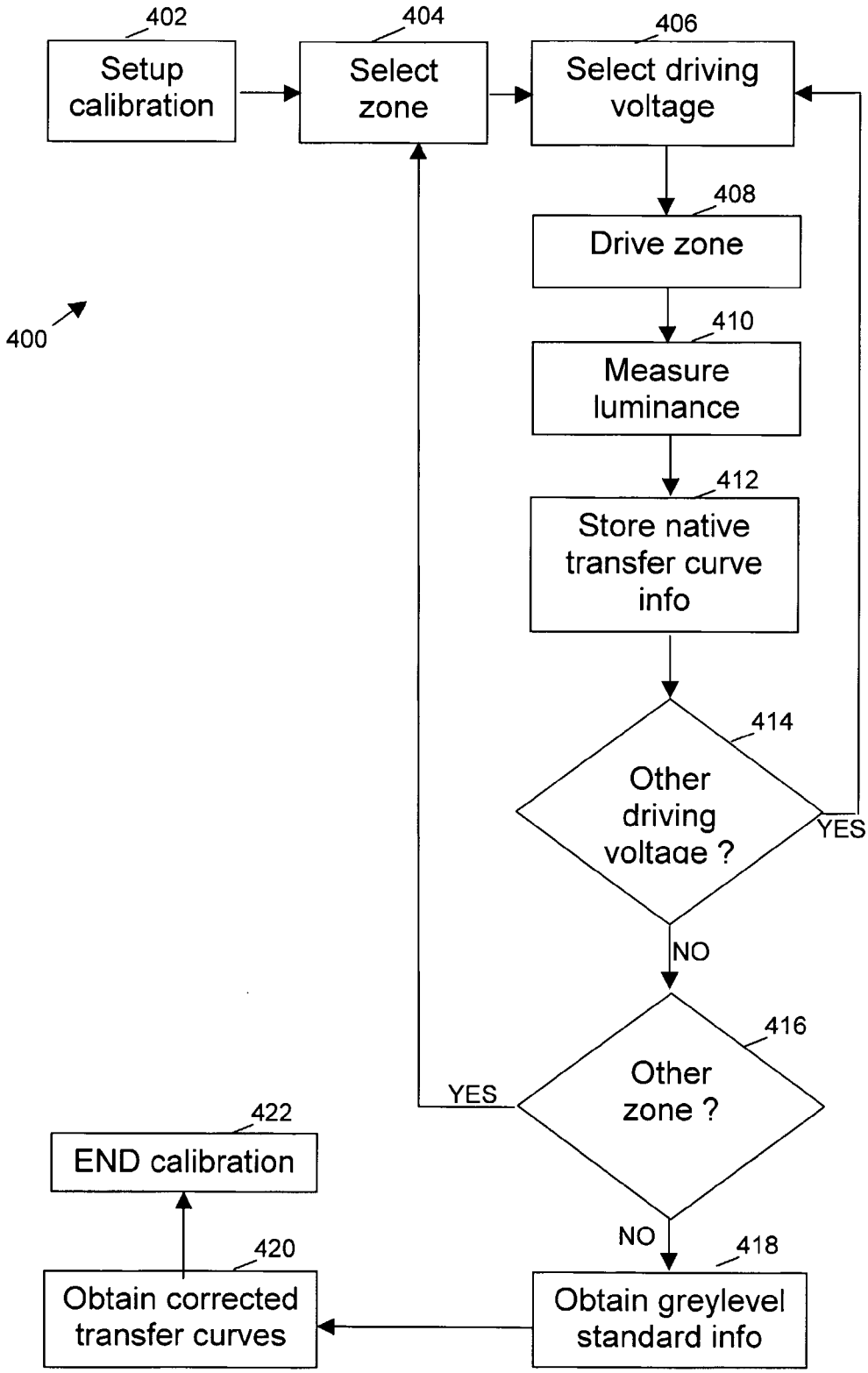
FIG. 10*a* is a first schematic flow-chart of a method for obtaining characterisation data for use for improving DICOM conformance according to an embodiment of the present invention.
Figure 10B:
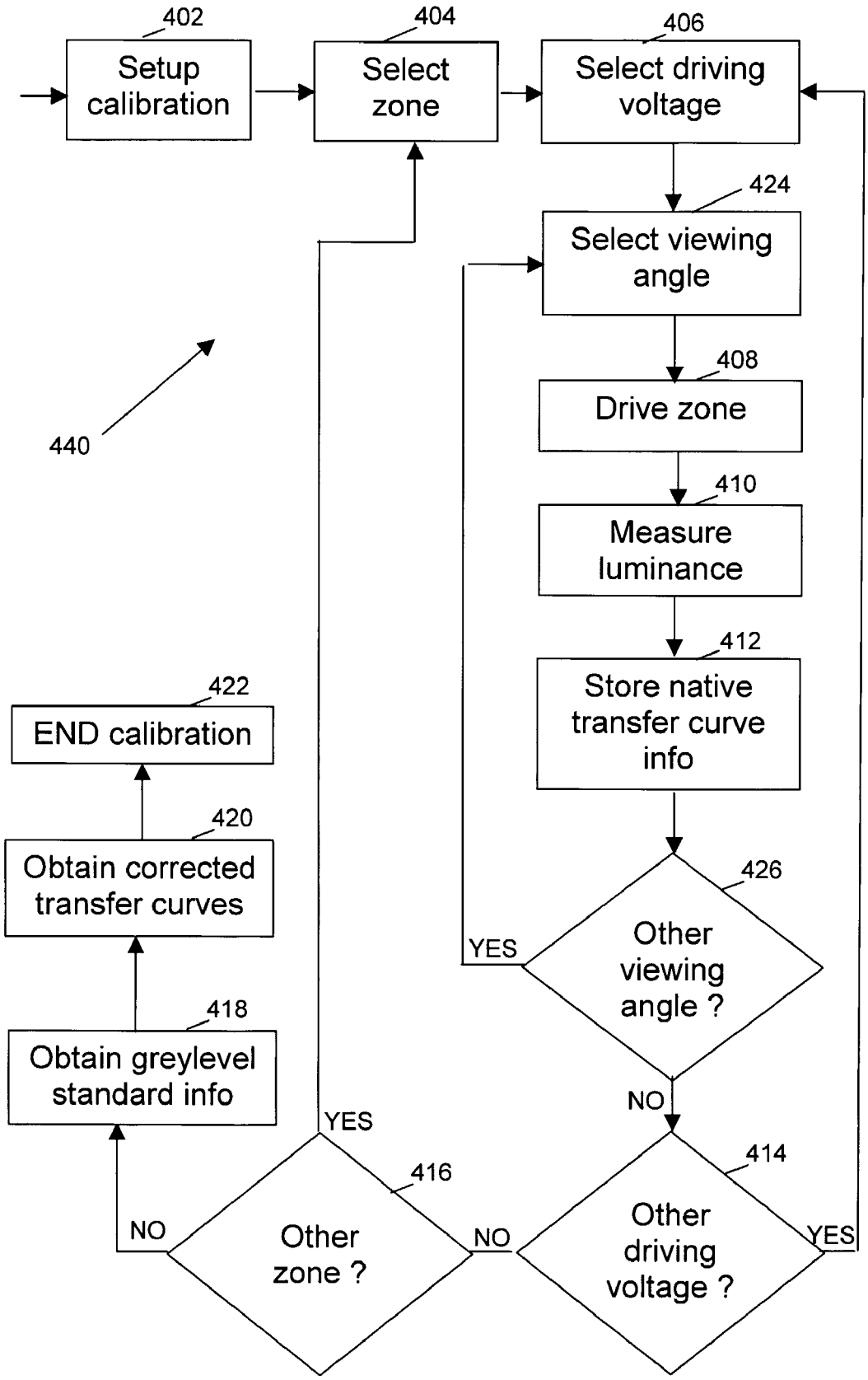
FIG. 10*b* is a second schematic flow-chart of a method for obtaining characterisation data for use for improving DICOM-conformance according to another embodiment of the present invention
Figure 10C:
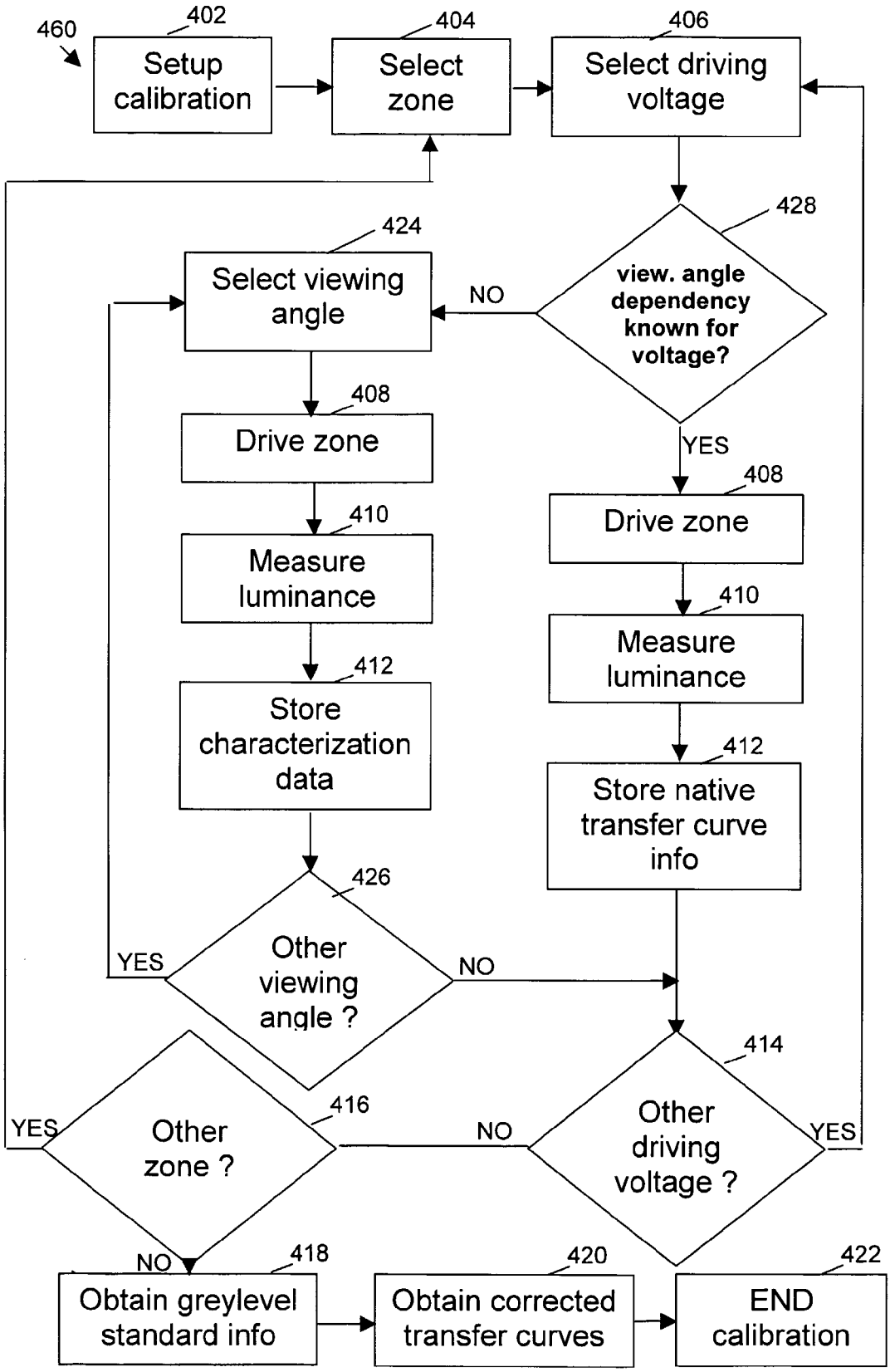
FIG. 10*c* is a third schematic flow-chart of a method for obtaining characterisation data for use for improving DICOM-conformance according to still another embodiment of the present invention.

In order to be able to adapt the image to be displayed so as to be DICOM standard compliant, calibration of the display system is required. In the following paragraphs a more detailed description of calibration methods according to embodiments of the present invention is provided. Depending on, amongst others, quality of the display system used, time and effort, the degree wherein the viewing angle is incorporated in the calibration can vary. FIG. 10*a*, FIG. 10*b* and FIG. 10*c* give an overview of different embodiments of methods for calibration that can be used according to the present invention.

In FIG. 10*a* the calibration method 400 does not include viewing angle dependent measurements but the viewing angle can be introduced from e.g. theoretical considerations or it can be assumed that the viewing-angle behaviour is proportional to the viewing-angle behaviour of a reference display system of the same type. In that case the viewing angle dependency can be characterised once and used for all panels of that type. The calibration method 400 for this embodiment involves the following steps.

In step 402 the calibration procedure is set up. This is typically done during manufacturing of the system, but it also can be performed at the place of use of the display system, e.g. if due to heating, aging or human intervention, such as e.g. adjusting of the backlighting, the characteristics of the system have been changed. In step 404 a zone or a pixel is selected for calibration. As described above, the calibration can either be done on zones in which the pixels are grouped or the calibration can be done on individual pixels or even on sub-pixels. The method then proceeds to step 406 wherein a driving voltage, referred to as digital driving level DDL in the DICOM specification, is selected. The number of driving voltages that is used during calibration depends on the system and can be more or less freely chosen. The condition to be fulfilled is that significant accurate information is to be obtained to substantially obtain the details of the native transfer curve. To reduce the number of driving voltages to be measured, interpolation can be used between measurement results. The selected driving voltage is then used to drive the selected zone or the pixel in step 408. As discussed above, if a zone is driven, this can either be a central pixel of a zone or a number of pixels in the zone, or it can be all pixels in the zone. Other specific pixel selections from the group of pixels forming a zone also can be used, as will be clear for a person skilled in the art. In step 410, the luminance of the driven zone is measured using a luminance detection system. The result of this measurement is stored in step 412, after which, in step 414, it is checked if all driving voltages for the selected zone are already used for obtaining the native transfer curve information. in this way, by driving the zone at different driving voltages, measuring the corresponding luminance level and storing the couples (driving voltage, luminance level) the native transfer curve information is obtained and stored. If all needed information about the native transfer curve for the currently selected zone is obtained, method 400 proceeds to step 416, where it is decided if another zone/pixel needs to be measured. If this is the case, the method returns to step 404, for characterising another zone or pixel. Otherwise all spatial information about the native transfer curves for the display system is obtained and method 400 proceeds to step 418. The information of the greyscale level display standard to be enforced is obtained, in the luminance range needed, i.e. depending on the measured luminance values. In step 420 the corrected transfer curves for the different pixels/zones of the display system are obtained by fitting the results to the greyscale level display standard information to be enforced. In this step, the viewing angle information for the display system which may be based on theoretical considerations or on measurements on a prototype display system, is also introduced, thus resulting in corrected transfer curves for the different pixels/zones and for different viewing angles.

In this calibration method it may thus be assumed that the spatial greyscale level display behaviour is the same for all the displays of a same type and that the calibration can be further reduced by measuring the spatial effects once on a reference display system.

In a more extended method 440 for calibrating, as shown in FIG. 10*b*, additional viewing angle measurements are performed, thus allowing to optimise the enforced greyscale level display standard conformance for viewing angle dependency. In FIG. 10*b*, method steps having the same reference signs as in FIG. 10*a* are as explained above, and are not explained here in detail.

After selection of the driving voltage in step 406, additional steps 424 and 426 are introduced such that for each zone/pixel and for each driving voltage the native transfer curve information can be stored for a number of viewing angles. The number of viewing angles used to obtain significant accurate transfer curve information depends on the display system used. The viewing angles can be divided into zones and interpolation can be used to obtain an approximate transfer curve for all viewing angles. Using interpolation allows to reduce the measurement time.

An alternative method 460 for calibrating, as shown in FIG. 10*c*, allows to measure the viewing angle dependency for one zone/pixel and uses this viewing angle dependency as the general viewing angle dependency. Here again, method steps having the same reference signs as in any of FIG. 10*a* or FIG. 10*b* are as explained above, and are not explained here in detail.

For a first zone/pixel, in an additional decision step 428 it is decided whether the viewing angle dependency for the selected driving voltage is known and if not, the method proceeds to step 424 such that the viewing angle dependency is measured for this zone/pixel. Further in the method, if another zone is selected, in decision step 428, the viewing angle dependency will be decided to be known from previous measurements and the viewing angle dependency will not be recorded anymore. The viewing angle dependency measured for the first zone will then be used in step 420 to obtain the appropriate corrected transfer curves for all pixels/zones. This significantly decreases measurement time since the viewing angle measurements do not need to be performed at multiple locations on the display.

It will be obvious for a person skilled in the art that although in the methods described above different viewing angles are selected for each driving voltage, it is also possible to select different driving voltages for each viewing angle. This may be even more advantageous as it implies that the position detection system needs to be changed less during the calibration procedure. The exact order wherein the zone (corresponding with the position on the display system), the driving voltage and the viewing angle are selected is not limiting for the invention. Furthermore, from the above methods it will be obvious that the invention relates both to methods wherein the viewing-angle is assumed independent of the spatial location at the matrix display and methods wherein the viewing-angle is dependent of the spatial location at the matrix display.

Although the calibration procedures described above typically will be used during manufacturing of the display system, the calibration values obtained can be further adjusted during use of the system. In a further embodiment of the present invention, the system may comprise a detection system for detecting the status of the back-light. This can be e.g. a detector that allows detection of the emission from the screen such that the intensity of the backlighting can be tested and such that the calibration information for conformance with the DICOM standard, or any other grey-level display standard, can be adjusted accordingly. Furthermore, changes of the native transfer curve of the display can be detected, if e.g. a photo-sensor is placed so that it measures on the front-side of the display area, i.e. the viewing side of the display area. This data can then again be used to adapt the calibration information for conformance with a grey-level display standard. Alternatively, the environmental conditions in the room for viewing can be measured by using a detection system somewhere in the room or preferably in the housing of the display so that the amount of environmental light that is present can be measured, as this will alter the viewing conditions and will influence the DICOM-conformance of the display. An example is given for a medical LCD-panel that has all pixels in dark state having a luminance of approximately 0.5 cd/m$^2$ and ambient light having a luminance between 0.1 cd/m$^2$, i.e. a completely dark radiology room for instance for mammography, up to 30 cd/m$^2$ in a normal office. If the front glass of the LCD-display typically has a reflection of about 5% and the ambient light changes from 10 cd/m$^2$ (rather dark office) to 30 cd/m$^2$ (normal working office) then the black level of the display changes from 1 cd/m$^2$ (=0.5 cd/m$^2$+0.5 cd/m$^2$) to 2 cd/m$^2$ (=0.5 cd/m$^2$+1.5 cd/m$^2$) resulting in an error of 100%.

In these embodiments, the calibration information used for adjusting to DICOM-conformance, or to conformance to any other greyscale or colour display standard, can be adjusted to influences of external factors. Detection at different locations on the display is possible but not always necessary, as the effects may be proportional for all spatial locations at the display and may be proportional for all viewing angles of the display.

The above description discloses a method and device for improving spatial and off-axis display standard conformance of display systems. As mentioned previously, in general the present invention can be applied to any situation where the transfer curve of each pixel or zone under all or some viewing angles needs to fulfil certain mathematical relationships. In case of the DICOM-conformance for example, the transfer curve and more particularly the luminance value of each pixel or zone needed to follow a certain mathematical curve as described by "DICOM/NEMA supplement 28 greyscale standard display function". A simple extension to this model can be that for small viewing angles the transfer curve indeed needs to follow that mathematical relationship but for larger viewing angles the transfer curve is changed to a constant function. This means that as long as the user looks at the display from small angles (and therefore the display behaviour is acceptable) the user sees the best available representation of the image, but from the moment the viewing angle becomes too large the display content is changed to a uniform greyscale level so that the user is warned that looking from that angle is not recommended. If the display behaviour is no longer acceptable, it is also possible to adjust the actual number of simultaneously presented greyscale values on the display. Suppose for instance that a viewing application shows 256 concurrent output greyscale values. After spatial and viewing angle correction, the output on the display has the best possible performance. From a certain viewing angle onwards, the display behaviour might not be acceptable anymore. In that case a signal could be sent to the application to decrease the number of output greyscale values, for instance to 128 output greyscale values. The spatial and viewing angle correction can also be adapted to generate the lower number of greyscale values. Because of the lower number of output greyscale values it will typically be easier to comply with an enforced display standard. Warning the user or reducing the number of output greyscale values may be e.g. performed when the viewing angle is outside the preferred ranges as described above. Warning the user that the display behaviour is not acceptable anymore could also be done by other means such as, but not limited to: showing a pattern on the screen (such as a text or an image, e.g. a checkerboard pattern) or overlaying the current screen contents, a sound, a visual signal such as one or more LEDs (control lights) or colour changes of LEDs, sending a message to the user through a communication medium such as telephone or gsm or sms or email, sending a message to a software application such as a QA (Quality Assurance) application or a PACS (Picture Archiving and Communication System) viewing application, writing a file on the hard disk of the PC, logging an event, etc. . . . .

It is to be noted that "not acceptable display behaviour" is not limited to the isolated display: it should be seen as a combination of display system (display, graphical card, processing unit such as e.g. PC, viewing application, quality of the link (bit error rate) between PC and display), environmental conditions (ambient light, actual contrast of the display system including ambient light, temperature, humidity, electromagnetic interference levels, . . . ), the user that is actually using the display, etc. . . . For instance, but not limited thereto: the user could be warned by any suitable means that the display behaviour is not acceptable anymore if the ambient light in the room is too high, or if the temperature is outside the display spec, and the threshold levels (when the display behaviour is acceptable and when not) could even be depending on the user actually using the display at that moment. Each user could for instance select other threshold levels for "acceptable display behaviour" or these threshold levels could be selected based on characteristics (such as quality of eyes, level of training or experience, . . . ) of each individual user or groups of users.

It is to be noted that several types of actions could be initiated if the display system behaviour is not acceptable anymore. As already mentioned, one of them could be reducing the number of simultaneously displayed shades of grey, even down to one single shade, or a very limited number of shades of grey, e.g. two, or displaying a pattern such as text or an image on the display. Other actions could include changing parameters relevant for the quality of the displayed image, e.g. changing the backlight luminance, setting a new peak luminance value of the display, setting a new calibrated white point luminance value of the display, setting a new colour point of the display, setting a new colour point of the backlight of the display, changing the ambient light intensity in the room, changing the colour point of the ambient light in the room, changing the temperature in the room, changing the humidity level in the room, changing the calibration tables of the enforced greyscale or colour display standard (for instance but not limited to DICOM calibration tables) inside the display or inside the graphical board or inside the PACS viewing application or on the host PC, changing specific settings in any program running on the PC (such as but not limited to a PACS viewing application, a QA application, . . . ), changing any settings of the graphical board such as but not limited to resolution, frame rate, colour depth, encoding scheme, palette mode, changing any settings of the display. Each of those actions has the intention to make the display system behaviour acceptable again, i.e. conformant with the enforced greyscale or colour display standard, or at least better (so optimised) compared to the current situation.

According to another aspect of the present invention, pre-correction could also include making the performance of the display system tolerant to parameter changes. This means that settings of the display system (display itself, graphical board, host PC, software applications, . . . ) are chosen so that the performance of the display system stays as stable (high) as possible, preferably within accepted behaviour, if a parameter relevant for the quality of a displayed image changes. Parameters relevant for the quality of a displayed image that can change are for example, but not limited to: the viewing angle(s) under which the user(s) looks at the display, the intensity of the ambient light, the colour point of the ambient light, the luminance of the backlight, the colour point of the backlight, the ambient or display system temperature, the humidity of the environment, . . . .

As example it is explained how to create a display system that has performance that is tolerant to changes in viewing angle under which the user looks at the display system. However, this example is not intended to limit the scope of the present aspect of the present invention: according to the present invention display systems may be provided that have a performance that is tolerant to changes in other parameters relevant for the quality of a displayed image as well, such as e.g. a change in intensity of the ambient light etc.

In the present embodiment, the viewing angle of the user with respect to the display can be represented by two angles: a horizontal and a vertical angle. As was explained before: if an enforced greyscale or colour display standard compliant system, such as e.g. a DICOM compliant display system, is desired for all viewing angles, then this can be solved by determining the exact viewing angle of the user with respect to the display at any moment, by calculating the required greyscale or colour display standard, e.g. DICOM, calibration curve for that viewing angle and by finally uploading that calculated calibration curve to the display, graphical board or application, wherever it is to be stored.

There are, however, several problems with this approach: first of all: it may not always be possible to determine the current viewing angle of the user with respect to the display, for instance if no viewing angle detection system is available due to technical or cost price reasons. A second problem is that even if there is such a system to measure the viewing angle, there is always a (preferably as small as possible) error on the estimated angle. This small error can still result in low compliance to the enforced standard, e.g. low DICOM compliance, if only the optimal DICOM calibration curve, e.g. calibration LUT or an analytical expression thereof, for that specific angle would be calculated. Indeed, at some viewing angles the characteristics of the display can change very rapidly so that even a small change in angle results in large differences in display behaviour. This also means that a calibration curve, e.g. LUT or an analytical expression thereof, that was calculated for slightly wrong viewing angle could result into large distortions compared to the desired standard display function.

Figure 11:
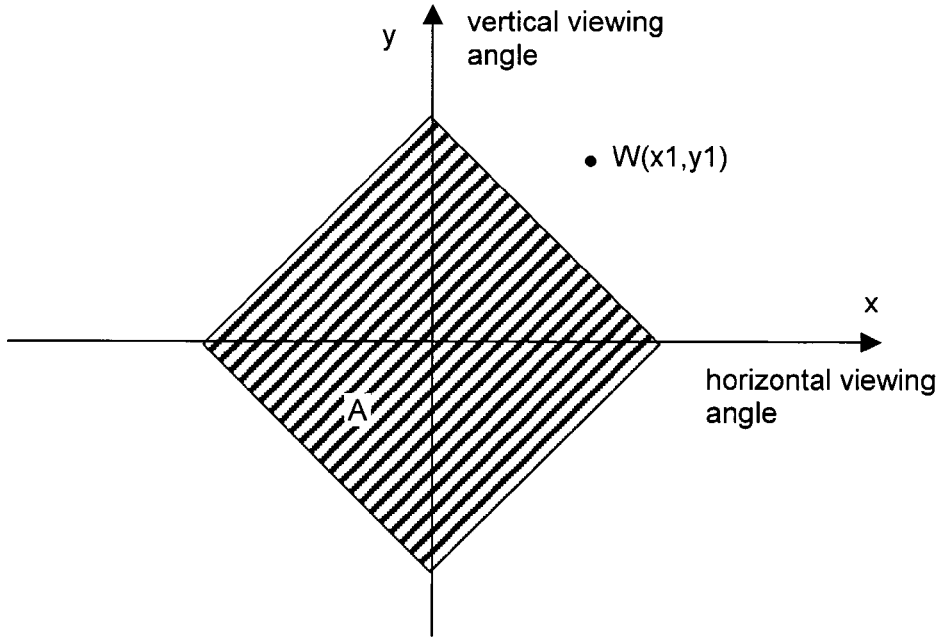
FIG. 11 illustrates a first weight being assigned to relevant viewing angles and a second weight (zero weight) being assigned to non-relevant viewing angles.

Now a method is explained to overcome these two problems. In case of a system without viewing angle estimation one could determine in some way the viewing angles that are most likely to be used by the users of the display. These can be plotted for instance in a two-dimensional plot where the x-axis represents the horizontal viewing angle and the y-axis represents the vertical viewing angle, as illustrated in FIG. 11. The value of a point in this (x,y) diagram then could represent the probability that the user will use this angle, or alternatively a metric that describes the importance of that specific angle for the specific application that this specific user want to perform (generalizing to classes of applications and classes of users is of course also possible). For example, the point w(x1, y1) in FIG. 11 represents the probability that a user will look at the display under a horizontal viewing angle x1 and under a vertical viewing angle y1. In other words, the point w(x1, y1) in FIG. 11 represents the importance of viewing angle (x1, y1). Once such plot is available then the goal is to find a calibration curve that will make sure that performance of the display system is maximized, and this for every relevant viewing angle. This means that a curve needs to be found that results into standard display function compliance (for instance but not limited to DICOM) for as many points of the (x, y) plot as possible, where the value of each point (importance of each point) is weighted with the assigned value (probability or importance of that point) for that point.

When, for example, taking the example of DICOM calibration, the problem is then to find a DICOM calibration curve that makes sure that as many points as possible in the (x, y) plot will be compliant to the enforced DICOM standard, whereby the points in the (x, y) plot are weighted according to importance. Such an example of weights could be for instance that on-axis viewing is very likely, and so has high weight, but also small angles in horizontal and near horizontal direction are important and therefore also have rather high weights. It is possible that points in the (x, y) diagram have zero weight (if they are of no importance) or even negative weights (if it is not desired that those points comply with the standard, for instance because a designer does not want the user to use the display for those angles). It is to be noted that assigning the weights to the points in the (x, y) diagram can be done in any way and that the assigned weights can be negative, zero or positive numbers of any precisions such as but not limited to integers, floating point numbers, fixed point numbers, . . . . The metric that determines whether a specific calibration curve, e.g. a calibration LUT or an analytical expression thereof, results into compliance with the desired standard display function can be an arbitrary function that can give as output both negative, zero and positive numbers. For example but not limited to: negative numbers could mean that this calibration curve results in non-compliance with the standard for that angle, zero could mean that it is compliant both only just within specs, a positive number could mean that the calibration LUT results in good compliance with the standard for that angle. It is to be noted that the result of the metric that determines whether a specific calibration curve can be of any precision such as, but not limited to, integer values, floating point values, fixed point values, . . . .

In fact what is described here is a maximization problem where the parameter space comprises the values of the calibration curve, e.g. calibration LUT or an analytical expression thereof. In other words: the values of the calibration curve need to be chosen so that the weighted sum of the result of the cost function over all (or some pre-determined, chosen) points in the (x, y) diagram is maximized. A parameter vector L needs to be selected, L being a set of parameters that need to be optimised. A cost function or metric C is established, describing the compliance of parameter vector L for the parameter under consideration compared to a desired standard, for example C(x, y; L) is the cost function describing the compliance of parameter vector L from the calibration curve for viewing angle (x, y), compared to the desired standard. The parameter vector L needs to be selected so that the weighted sum of the result of the cost function C for each point and that vector L over (some part of) a space (for instance 2 dimensional: horizontal and vertical viewing angle, for instance 3 dimensional: horizontal and vertical viewing angle and white luminance of the display, for instance 4 dimensional: horizontal and vertical viewing angle and white luminance of the display and ambient light intensity, . . . ) is maximized, i.e. $\text{maximize}_L$ $$\sum_{areaA} w(x, y)C(x, y; L),$$

or thus find those L that maximize the weighted sum of the const function C and this for an area A in the (x,y) space.

If this is done in the example of horizontal and vertical viewing angle and calibration curve, then a calibration curve will be obtained that results into the highest performance that is possible for the areas in the (x, y) space that is marked (by means of the weights) as important, e.g. area A In other words: within the area A marked as important this calibration curve will result into good compliance, meaning that as long as one stays inside this area A marked as important, the performance of the calibration curve will be good and therefore the exact horizontal and vertical angle is not that important. This means that a system has been developed that is able to calculate a calibration curve that is more or less invariant to horizontal and vertical viewing angle within predetermined range.

As already explained: this technique can be used if no viewing angle measurement system is available. Then the set of viewing angles that are important is estimated, e.g. a range of standard viewing angles is selected, such as for example between −20° and +20°, and the optimal calibration curve, e.g. represented as a calibration LUT or an analytical expression thereof, for that set of viewing angles is calculated.

If a system is available for measuring the viewing angles then the above technique can still be used to solve inaccurate viewing angle measurements. Indeed, if the calibration curve would still be optimised for a set of angles that are near to the measured viewing angle, i.e. within a range of a few degrees from the measured viewing angle, preferably within a range of 10 degrees or less from the measured viewing angle, then the display performance with that calibration curve will actually be acceptable with a bigger degree of certainty even if the viewing angle measurement was not completely accurate. The exact selection of this set of viewing angles and the corresponding weights for these points in the (x, y) diagram do not limit the present invention. It is clear for someone skilled in the art that a lot of variations to select this set and corresponding weights are possible.

Figure 12:
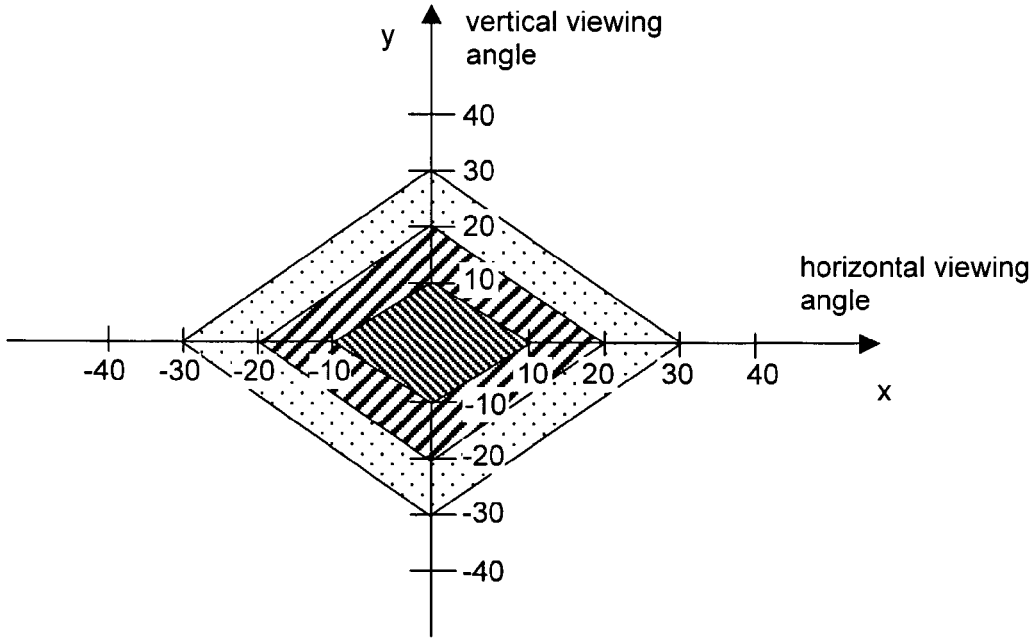
FIG. 12 illustrates a first weight being assigned to most relevant viewing angles, a second weight being assigned to less relevant viewing angles, a third weight being assigned to still less relevant viewing angles, and a fourth weight (zero weight) being assigned to non-relevant viewing angles.

In FIG. 12, a further example of the above method is illustrated, in which different weights are assigned to different points in the (x,y) space. In the example illustrated in FIG. 12, there are four different values: viewing angles around (0,0), i.e. viewing angles which are on-axis both in horizontal direction and vertical direction, or which are close to on-axis, have a first, high weight value because the user is likely to view on-axis or closely there to. Viewing angles which are between 10° to 20° off-axis either in horizontal or in vertical direction, or in both directions, have a second weight value, the second weight value being lower than the first weight value. Viewing angles which are between 20° and 30° off-axis either in horizontal or in vertical direction, or in both directions, have a third weight value, the third weight value being lower than the second weight value. Viewing angles which are more than 30° off-axis in either or horizontal or vertical direction, have a fourth weight value, which may for example be zero.

It is to be noted that the same concept could also be described as a minimization problem instead of a maximization problem. Of course this does not limit the present invention.

This technique can of course be applied in general to higher dimension parameter vectors and search spaces. Higher dimension parameter vectors (that will be optimised) may comprise for instance, but are not limited to (at least combinations or subsets are possible): multidimensional lookup tables, peak luminance of the display, calibrated luminance of the display, colour point of the display, ambient light intensity, colour point of the ambient light, ambient temperature, ambient humidity, etc. . . . .

Higher dimensional search spaces may comprise for instance, but are not limited to (at least combinations or subsets are possible): horizontal and vertical viewing angle, distance to the display, ambient light intensity, colour point of the ambient light, ambient temperature, etc. . . . .

When using these higher dimensionality parameter vectors or search spaces the general concept stays the same and it is still within the scope of the present invention.

The present invention furthermore is not limited to greyscale displays. A reference work for colour imaging is "Colour Vision and Colourimetry, Theory and Applications" by Daniel Malacara. By way of example, the invention not being limited thereto, the use of a colour display to view greyscale images is described. In that case the input of the display system is a greyscale image, but the display system itself has colour possibilities. An equivalent mathematical description of the "DICOM/NEMA supplement 28 greyscale standard display function" can then be used. If each pixel for example consists of three sub-pixels, the mathematical description will then involve a combination of the three transfer curves of the individual colour sub-pixels and will state that a mathematical function of those three transfer curves, which is used to calculate the luminance value from individual colours, for each pixel should follow a certain curve, i.e. the greyscale standard display function. In this situation there are extra degrees of freedom as it is possible to obtain the same luminance value with different driving signals for the three sub-pixels. In other words, with different driving signals for the three sub-pixels a resulting output having the same luminance but a different colour point, as described for example—but not limited to—by CIE colour co-ordinates x,y, can be obtained. These additional degrees of freedom can be used to obtain a specific colour behaviour, which is to be obtained in addition to the greyscale standard display function. A first example of such a specific colour behaviour is selecting a constant specific colour point for the greyscale values. In this case, after spatial and viewing angle-correction, the pixels should follow the specific luminance greyscale standard curve, e.g. the DICOM GSDF, and the colour co-ordinates should remain at a specific, user-selected, value when following this greyscale standard curve. Another example of specific colour behaviour is that, together with the greyscale standard to be complied with, a change in colour is obtained. This can be done by e.g. forcing the colour co-ordinates to comply with a specific curve, e.g. forcing the colour co-ordinates such that a linear change between green and red is obtained when following the greyscale standard curve from minimum to maximum. It will be obvious for a person skilled in the art that variants on standards for colour co-ordinates can also be used and that the invention is not limited thereto. In other words, the present invention also relates to a method and system whereby for all pixels and viewing angles, or for a limited number of zones or viewing angles, when changing the input greyscale stimulus from minimum to maximum, the output luminance of the display system complies with a greyscale standard to be followed and for all pixels and viewing angles, or for a limited number of zones or viewing angles possibly different from the ones described above, when changing the input greyscale stimulus, the output of the display system, more specifically the colour co-ordinates comply with a specific selected mathematical curve (for instance a constant, a linear curve between two colour points, . . . ). It is to be noted that the mathematical curve does not need to be constant but that it also can be time-dependent or depend on other parameters such as e.g. external measurement data, external factors, . . . . The conversion from R,G,B values of the display system to colour co-ordinates such as the CIE x,y co-ordinates is well-known for a person skilled in the art. This can be e.g. done by measuring the colour-co-ordinates of all or a selection of R,G,B values and applying the inverse transformation if a conversion from R,G,B to x,y co-ordinates is needed. Another possibility is to theoretically deduce the colour co-ordinates for all R,G,B display values based on a limited number of measurements, such as the transfer curve of the R,G and B sub pixels and the colour co-ordinates of the fully-on and fully-off state of the R,G and B sub pixels.

The invention also can be used in colour critical images. In that case the display input is a colour image, as described for example by R,G,B values in a specific colour profile, and the display system also allows colour output. The goal is then to improve the conformance of the display output image to the user selected colour profile and this by applying spatial and viewing-angle corrections. To do this, a mathematical relationship can be defined that states that the combination of the three transfer curves of all pixels/zones should result in a specific colour profile. This mathematical relationship allows calculating x,y-colour coordinates from the three colour transfer curves together. In that case this could mean that spatial and off-axis correction are applied to each individual sub pixel or zone so that the resulting perceived colour, as expressed by the x,y-colour coordinates, is constant for all locations on the display and remains correct if the user looks at the display off-axis. Although the invention is not limited thereto, the input image typically is specified in R,G,B colour co-ordinates in a specific colour profile. The specific colour profile can be user-defined and may easily be converted to standard colour co-ordinates such as e.g. the CIE X,Y,Z-system. The image to be displayed typically is specified in a standard colour co-ordinate system that differs from the native R,G,B output colour profile of the display system. To obtain an appropriate colour output, a spatial and viewing-angle correction system can be applied in the same way as described for greyscale curves. To obtain this the characterisation data that defines the output—as specified in a standard colour co-ordinate system—as a function of the drive signals, the spatial location at the display and the viewing angle can be measured or calculated mathematically. The output can be e.g. specified in the CIE X,Y, Z colour co-ordinate system, and the drive signals can be e.g. given in R, G and B values. In this way the transfer curve, which is multi-dimensional, is obtained, i.e. (X,Y,Z)=f(R,G,B, spatial location, viewing angle). The latter allows to easily calculate the required correction for spatial and viewing-angle dependency. This can be done by just inverting the function f(R,G,B, spatial location, viewing angle) for the specific location and viewing angle required. The result thus gives the required R,G,B input value of the display system that corresponds with the input value in the original colour image.

It is to be noted that it is also possible to mix colour standards and greyscale standards. An example could be that both a specific colour profile and a specific luminance standard response should be followed. Furthermore, these corrections can be adapted real-time based on external measurements such as, but not limited to, backlight intensity, native curve measurements, ambient light measurements, . . . .

Yet another example is for displaying images where absolute colour co-ordinates are less important but differences between colours are important. In this case the spatial and off-axis correction are applied such that differences between colours, as expressed e.g. in colour JNDs, are displayed in the same way for all locations on the display and for all viewing angles.

The present invention relates not only to a system wherein an optimised conformance to an enforced greyscale or colour display standard may be provided, it also relates to the corresponding method for adjusting images and displaying adjusted images conform an enforced greyscale or colour display standard and it furthermore also relates to the methods described for calibrating a system such that it is conform an enforced greyscale or colour display standard.

It is an advantage of the embodiments of the present invention that the correction method to obtain improved enforced display standard behaviour allows correction for the individual greyscale or colour behaviour of each pixel/zone. The obtained transfer curve for each pixel/zone is such that each of those transfer curves fulfils the enforced display standard behaviour. The obtained transfer curves for each pixel/zone do not enforce all pixels/zones to the same minimum and maximum brightness and even for pixels/zones having the same minimum and maximum brightness, the correction curves may differ to obtain an optimum individual enforced display standard behaviour. In the present invention, therefore, no equal transfer curves for each pixel/zone are provided, but the transfer curve for each pixel/zone is optimised individually. It furthermore is an advantage of the embodiments of the present invention that a "time-dependent" correction is provided, depending on at least some circumstances in which the display system is used. Another advantage of the present invention is that the applied correction furthermore allows adjusting the degree of output greyscale depth, e.g. by decreasing the output greyscale depth if for certain large viewing angles no compliance is obtained with the enforced display standard.

Other arrangements for accomplishing the objectives of the system and method for improving enforced display standards embodying the invention will be obvious for those skilled in the art.

It is to be understood that although preferred embodiments, specific constructions and configurations, as well as materials, have been discussed herein for devices according to the present invention, various changes or modifications in form and detail may be made without departing from the scope and spirit of this invention.

The invention claimed is:

1. A method for correcting non-conformance in greyscale or colour values of a plurality of zones of pixel elements in a matrix display, the correcting being with respect to an enforced greyscale or colour display standard, each zone of pixel elements being corrected by a different calibration function, the method comprising, for each zone of pixel elements independently, storing characterisation data characterising the non-conformance in greyscale or colour values of the zone of pixel elements as a function of its drive signals, the drive signals corresponding to a number of greyscale or colour levels, pre-correcting, in accordance with the characterisation data, the drive signals of said zone of pixel elements so as to obtain a greyscale or colour level conforming to said enforced greyscale or colour display standard, said pre-correcting being performed based on an input value of the greyscale or colour value to be displayed and the viewing angle under which the zone of pixel elements is or is to be viewed at, reducing the number of greyscale or colour levels by adjusting the drive signals, if the viewing angle under which the zone of pixel elements is or is to be viewed at, is outside a pre-determined range.

2. The method according to claim 1, wherein adjusting the pre-correcting comprises changing the display content to a uniform greyscale level.

3. The method according to claim 1, wherein a zone of pixel elements consists of one pixel element.

4. The method according to claim 1, wherein a zone of pixel elements comprises a plurality of pixel elements, each pixel element of a zone being assigned a same characterisation data.

5. The method for correcting according to claim 1, wherein said viewing angle under which the matrix display is or is to be viewed at is selectable by a user.

6. The method for correcting according to claim 1, wherein said viewing angle under which the matrix display is or is to be viewed at is measured using a detection system.

7. The method for correcting according to claim 1, wherein said characterisation data furthermore comprises at least one of dependence on back-light intensity, dependence on an environmental parameter.

8. The method according to claim 7, wherein said environmental parameter is the intensity of environmental light.

9. The method for correcting according to claim 1, wherein said pre-correcting the drive signal is performed based on using a look-up table.

10. The method for correcting according to claim 1, wherein said pre-correcting the drive signal is performed at least partially based on using a mathematical function.

11. The method according to claim 1, further comprising generating the characterisation data from images captured from individual zones of pixel elements.

12. The method according to claim 11, wherein generating the characterisation data comprises building a pixel element profile map representing characterisation data for each pixel element of the matrix display.

13. The method for correcting according to claim 1, wherein the pre-correcting is carried out in real-time during driving of the matrix display while displaying images.

14. The method for correcting according to claim 1, wherein the pre-correcting is carried out off-line at a time other than during driving of the matrix display while displaying images.

15. The method for correcting according to claim 1, wherein said enforced greyscale display standard is the Digital Imaging and Communications in Medicine (DICOM) standard published by National Electrical Manufacturers Association.

16. A system for correcting non-conformance in greyscale or colour values of a plurality of zones of pixel elements in a matrix display, the correcting being with respect to an enforced greyscale or colour display standard, the system comprising a memory means for storing characterisation data characterising the non-conformance in greyscale or colour values of the plurality of zones of pixel elements as a function of its drive signals and as a function of a viewing angle under which the zone of pixel elements is to be viewed, the drive signals corresponding to a number of greyscale or colour levels, a correction device for pre-correcting, in accordance with the characterisation data, drive signals to the zone of pixel elements to obtain a greyscale or colour level conforming to the enforced greyscale or colour display standard, and adapted for reducing the number of greyscale levels or colour levels by adjusting the drive signals, if the determined viewing angle is outside a pre-determined range.

17. The system according to claim 16, wherein the correction device is adapted for adjusting the drive signals to the zone of pixel elements so as to obtain a single greyscale or colour level.

18. The system according to claim 16, furthermore comprising a characterising device for generating characterisation data for a number of zones of pixel elements by establishing a relationship between the greyscale or colour levels of each of said zones of pixel elements and the corresponding drive signal for a number of viewing angles and a number of spatial locations in the matrix display.

19. The system according to claim 18, wherein said characterising device comprises an image capturing device for generating an image of the pixel elements of the matrix display.

20. The system according to claim 18, wherein the characterising device comprises a light-output value assigning device providing a native greyscale or colour luminance level as a function of its drive signals to a number of zones of pixel elements of the matrix display.

21. The system according to claim 16, wherein the correction device comprises a viewing angle determination device for determining the viewing angle of a user with respect to a display system.

22. A matrix display device for displaying an image, the matrix display device comprising: a plurality of zones of pixel elements and comprising further the system according to claim 16.

23. A control unit for use with a system for correction of non-conformance in greyscale or colour values of a plurality of zones of pixel elements of a matrix display for displaying an image, the correction being with respect to an enforced greyscale or colour display standard, the control unit comprising the system according to claim 16.

* * * * *